US005477245A

United States Patent [19]

Fuse

[11] Patent Number: 5,477,245

[45] Date of Patent: Dec. 19, 1995

[54] TEMPERATURES CONTROL SYSTEM FOR INK-JET RECORDING APPARATUS

[75] Inventor: Takeshi Fuse, Kanagawa, Japan

[73] Assignee: Fuji Xerox Co., Ltd., Tokyo, Japan

[21] Appl. No.: 83,336

[22] Filed: Jun. 29, 1993

[30] Foreign Application Priority Data

Jun. 30, 1992 [JP] Japan ..... 4-196064
Oct. 26, 1992 [JP] Japan ..... 4-310987

[51] Int. Cl.[6] ..... B41J 29/38

[52] U.S. Cl. ..... 347/10; 347/12; 347/14

[58] Field of Search ..... 347/9, 10, 11, 347/14, 17, 35, 57, 58, 60, 56, 12, 13, 42, 180, 181, 182

[56] References Cited

U.S. PATENT DOCUMENTS 4,791,435 12/1988 Smith et al. ..... 347/60
5,172,134 12/1992 Kishida et al. ..... 347/56

FOREIGN PATENT DOCUMENTS 0505154 9/1992 European Pat. Off. ..... 347/14
1-127361 5/1989 Japan .
3-218840 9/1991 Japan .

*Primary Examiner*—Benjamin R. Fuller
*Assistant Examiner*—John E. Barlow, Jr.
*Attorney, Agent, or Firm*—Finnegan, Henderson, Farabow, Garrett & Dunner

[57] ABSTRACT

An ink-jet recording apparatus of the present invention is provided with a carriage which moves relatively to a recording medium, one or a plurality of head cartridges which are detachably mounted on the carriage, each of the head cartridges having a plurality of nozzles, the plurality of nozzles being divided into a plurality of nozzle groups each having a predetermined number of the nozzles, each of the nozzle groups sequentially ejecting ink to perform recording for one line in an arrangement direction of the nozzles, a first storage device for storing a piece of drive pulse width data for driving the nozzles, a second storage device for storing one or more pieces of drive pulse width data for driving the nozzles, a drive pulse generating unit for generating a drive pulse width for driving the nozzle groups in accordance with the drive pulse width data stored in the first storage device or the second storage device, and further a temperature detecting device for detecting a temperature of the head.

5 Claims, 19 Drawing Sheets

TEMPERATURES CONTROL SYSTEM FOR INK-JET RECORDING APPARATUS

BACKGROUND OF THE INVENTION

The present invention relates to an ink-jet recording apparatus which performs the recording by ejecting ink to a recording medium.

Conventionally, an ink-jet recording apparatus is developed in which ink is heated by a heater to generate air bubbles in the ink, and the ink is ejected with the pressure caused by the expansion of the air bubbles to a recording medium from an ejecting port of a head, thereby performing the recording.

With such an ink-jet recording apparatus, the heating of ink causes temperatures of the head and ink to change during the recording. It is observed that the temperature change of the ink causes the recorded image density to remarkably vary.

Under a high temperature environment, the ink amount of an ink drop to be formed increases in accordance with the decrease of the viscosity of ink. Therefore, dots having a larger diameter are formed on a recording medium. By contrast, under a low temperature environment, the viscosity of ink increases so that the ink amount of an ink drop to be formed decreases. Therefore, dots having a smaller diameter are formed on a recording medium. Moreover, depending on the ink temperature, the ink ejection speed also varies. As a result, the landing positions of ink drops are scattered. This largely affects the image quality. Particularly, when the print operation is halted for a long time period under the low temperature environment, the temperature of the head falls, resulting in that, when the next print operation is performed immediately after the halt, the diameter of dots constituting an image is small and the ejection performance is not stable, thereby producing a problem in that the image quality is deteriorated.

From the above, it will be noted that, if the ink temperature or head temperature is controlled so as to be kept constant throughout the printing period and the printing halt period, the ink ejection performance in the printing is stable and the ink amount of an ink drop can be made uniform, thereby eliminating the problems in the image quality such as the density variation. In the prior art, therefore, there is a problem of how to perform the recording operation while keeping the head temperature constant.

In order to solve the problem, some methods are hitherto proposed. One of the methods is disclosed in Unexamined Japanese Patent Publication No. HEI. 3-218,840. According to this method, when the recording is to be continuously performed on a plurality of recording media, the head is driven in such a degree that ink is not ejected, during a predetermined time period from the end of the recording for a first recording medium to the start of the recording for a second recording medium, thereby raising the head temperature to a prescribed temperature. Thereafter, the recording for the second recording medium is started. Therefore, the density variation among recording media can be eliminated, and a stable image quality can be always obtained even under a low temperature environment.

However, this method has a drawback that, when a low image density printing is to be performed under a low temperature environment, the head temperature is raised to the prescribed temperature at the start of the recording for one sheet, but the head temperature falls in the recording for the end portion of the sheet, thereby causing the start and end portions of the sheet to have different image densities. In such a case, furthermore, the head temperature considerably falls at the end of the printing for the sheet. This probably requires a long time period for raising the head temperature during the predetermined time period before the start of the printing of the next sheet. During this time period, it is necessary to stop the print operation, and the host computer is requested to stay in the waiting state. Therefore, this method may cause the processing speed of the whole system to reduce.

The above-identified publication discloses also that, even in the printing of one line, the ink flow path is kept heated by driving the recording head with a pulse width stored in a memory by which ink can be ejected, or by which ink cannot be ejected. However, these pulse widths are not set for every line depending on the temperature change during the recording for a single sheet. Therefore, the image density is also different between lines in a single sheet.

Further, Unexamined Japanese Patent Publication No. HEI. 1-127,361 discloses another method including a first control device for generating and supplying a drive signal for ejecting ink, and a second control device for generating and providing a drive signal by which ink cannot be ejected. Both the devices are simultaneously operated so that, in a predetermined time period, the power consumption of a nozzle which ejects ink is approximately equal to that of a nozzle which does not eject ink. Therefore, the differences in temperature between the nozzles are eliminated, and the ink amount of an ink drop is constant for both the nozzles, thereby preventing the image quality deterioration from occurring in a single sheet.

Also in this method, as in the above-mentioned prior art example, the ink ejection failure and the density variation due to the variation in the ink temperature can be prevented. However, in this method, two drive pulse generating units are provided and simultaneously operated, so that nozzles which are not ejecting ink are also driven. Therefore, the amount of currents consumed by the head is increased as a whole, producing a problem in that it requires a power source apparatus of a larger size. Moreover, in the drive method, nozzles which are not ejecting ink and nozzles which are ejecting ink are controlled so as to consume almost the same power. Therefore, all the nozzles are apparently in the state of ejecting, so that the head temperature becomes significantly high. Conversely, in this method, unless the head temperature is made high, the variation in temperature between the nozzles cannot be eliminated.

When the head temperature is too high, the ink pressure balance in the ink flow path and the bubble formation balance are lost. There are problems in that the ink ejection direction is disordered, and that external air is introduced into the ink flow path through a nozzle to make the ink ejection disabled. In view of these problems, under a high temperature environment, it is necessary to inhibit the operation of the second drive pulse generating unit, or to change the first and the second drive pulse widths so as to reduce the applied energy. In the former method, the second drive pulse generating unit becomes unnecessary. In the latter method, it is necessary to determine the first and the second drive pulse widths. When this determination is done without considering the image density, there arises a danger that the head temperature will rise still more. Therefore, the above-mentioned ink ejection is more dangerous to occur a failure. As described above, the method in which the head temperature is kept constant in a high temperature range has a problem.

Recently, it becomes possible to use a head cartridge which contains a digital circuit to allow the interface to the body of the apparatus to be simplified. Such a head is allowed to be driven through a few signal lines from the body of the apparatus. Therefore, the number of cables connecting the head to the body of the apparatus can be remarkably reduced. In such a head cartridge containing a digital circuit, nozzles which are aligned in a line are generally divided into groups each having several nozzles, and the nozzles belonging in one group are simultaneously driven so that a nozzle drive pulse width is commonly used in one nozzle group. Apparatuses in which nozzle groups are driven are disclosed in, for example, Unexamined Japanese Patent Publication No. SHO. 58-36,461. When such a head is used, it is impossible to perform the control that the divided nozzle groups are simultaneously applied with the first and second drive pulse widths which are different from each other.

SUMMARY OF THE INVENTION

The present invention has been conducted in view of the above problems. An object of the present invention is to provide an ink-jet recording apparatus which can perform a stable head temperature control under any temperature environment.

The ink-jet recording apparatus of the present invention provides a carriage which moves relatively to a recording medium, and one or a plurality of head cartridges which are detachably mounted on the carriage, each of the head cartridges having a plurality of nozzles, the plurality of nozzles being divided into a plurality of nozzle groups each having a predetermined number of the nozzles, each of the nozzle groups sequentially ejecting ink to perform recording for one line in an arrangement direction of the nozzles, a temperature detecting device for detecting a temperature of the head, a first storage device for storing a piece of drive pulse width data for driving the nozzles, a second storage device for storing one or more pieces of drive pulse width data for driving the nozzles, and a drive pulse generating unit for generating a drive pulse width for driving the nozzle groups in accordance with the drive pulse width data stored in the first storage device or the second storage device.

In another aspect of the present invention, the drive pulse width data stored in the first memory device is set so as to be variable in a range where ink can be ejected, the drive pulse width data stored in the second memory device is set so as to be variable in a range where ink can be ejected, in a preset temperature, and to be variable in a range where ink cannot be ejected, at the preset temperature or a lower temperature, and the drive pulse width data stored in the first memory device is greater than the drive pulse width data stored in the second memory device.

In a further aspect of the present invention, the ink-jet recording apparatus further comprises a print data processing control unit for controlling print data and setting data so as to be printed, when there is no data to be printed in nozzle groups to be driven, during a print recording operation under an environment of a preset temperature or a lower temperature, one of the pieces of drive pulse width data stored in the second memory device is selected, and the nozzle groups in which there is no data to be printed is also driven.

In a still further aspect of the present invention, the print data processing control unit is controlled so as to operate at the preset temperature or a lower temperature, to generate data for causing at least one nozzle in the nozzle group to be driven, to print, and to selectively determine the number of data pieces to be generated and the position of the nozzle.

In a still further aspect of the present invention, the ink-jet recording apparatus further comprises a print density detecting unit for detecting a print density in the nozzle group to be driven, during a print operation under an environment at the preset temperature or a higher temperature, and either of the drive pulse width data stored in the first memory device and the drive pulse width data stored in the second memory device is selected on the basis of a detected result to sequentially generate a drive pulse, and to sequentially drive the plurality of nozzle groups.

In a still further aspect of the present invention, when either of the drive pulse width data stored in the first memory device and the drive pulse width data stored in the second memory device is selected by the print density detecting unit based on the detected result, a reference for the selection is variable.

In a still further aspect of the present invention, during a recording operation under an environment in a preset temperature range, only the drive pulse width data stored in the first memory device is used, and the selection of the drive pulse width data stored in the second memory device and the generation of the print data in the print data processing control unit is inhibited.

In a still further aspect of the present invention, the number of nozzles to be simultaneously driven is at least one.

According to the present invention, the temperature detecting device, the first and storage devices each for storing a drive pulse width data, and a drive pulse generating unit are provided for each of the heads, and one of the drive pulse width data is selected at a high speed for each of simultaneously driven nozzle groups. Therefore, by a relatively simple circuit, the drive control for each of the nozzle groups in accordance with the head temperature can be realized and the head temperature control can be stably performed.

In the other aspect of the present invention, the drive pulse width data stored in the first memory device is set so as to be variable in a range where ink can be ejected, and the drive pulse width data stored in the second memory device is set so as to be variable in a range where ink can be ejected, in a preset temperature, and to be variable in a range where ink cannot be ejected, at the preset temperature or a lower temperature. Accordingly, the head temperature control can be performed in the following manner: when the apparatus is used under a high temperature environment, the drive pulse width is shortened so as to reduce the heat generation; and, when the apparatus is used under a low temperature environment, a nozzle which is not used for printing is heated.

In the further aspect of the present invention, in the print recording operation under an environment of a preset temperature or a lower temperature, a drive pulse width data by which ink is not ejected is set in the second storage device. When there is no print data in the nozzle group to be driven, the print data processing control unit sets print data to be printed by the head and drives the nozzle group which does not perform the printing. Therefore, even when an image of a low print density is to be printed under a low temperature environment, the head temperature is prevented from falling.

In the still further aspect of the present invention, the print data processing control unit is controlled so as to operate at the preset temperature or a lower temperature, to generate data for causing at least one nozzle in the nozzle group to be driven, to print, and to selectively determine the number of data pieces to be generated and the position of the nozzle. Therefore, the variation in temperature between nozzles can be suppressed to a low level, and the head temperature under a low temperature environment can be controlled so as to be constant.

In the still further aspect of the present invention, in a print operation under an environment at the preset temperature or a higher temperature, the print density detecting unit detects a print density in the nozzle group to be simultaneously driven, and either of the drive pulse width data stored in the first memory device and the drive pulse width data stored in the second memory device is selected on the basis of the detected print density. When the print density is high, the data of the narrower drive pulse width is selected. This can reduce the heat generation so that the heat accumulation under a high temperature environment can be prevented from occurring.

In the still further aspect of the present invention, the print density detecting unit operates in such a manner that the criterion of selecting the drive pulse width data stored in the first and second memory devices can be changed. Therefore, the heat accumulation can be prevented and the heating control can be performed not only under a high temperature environment but also under the optimum environment.

In the still further aspect of the present invention, during a recording operation in a preset range, only the drive pulse width data stored in the first memory device is used. The head temperature is prevented from rapidly falling or rising.

In the still further aspect of the present invention, the number of nozzles to be simultaneously driven is at least one whereby the temperature control suitable for the structure of the used head can be realized.

BRIEF DESCRIPTION OF THE DRAWINGS

FIG. 6 is a drive timing chart for nozzle groups in the head of the ink-jet recording apparatus according to the present invention;

DETAILED DESCRIPTION OF THE PREFERRED EMBODIMENTS

Figure 1:
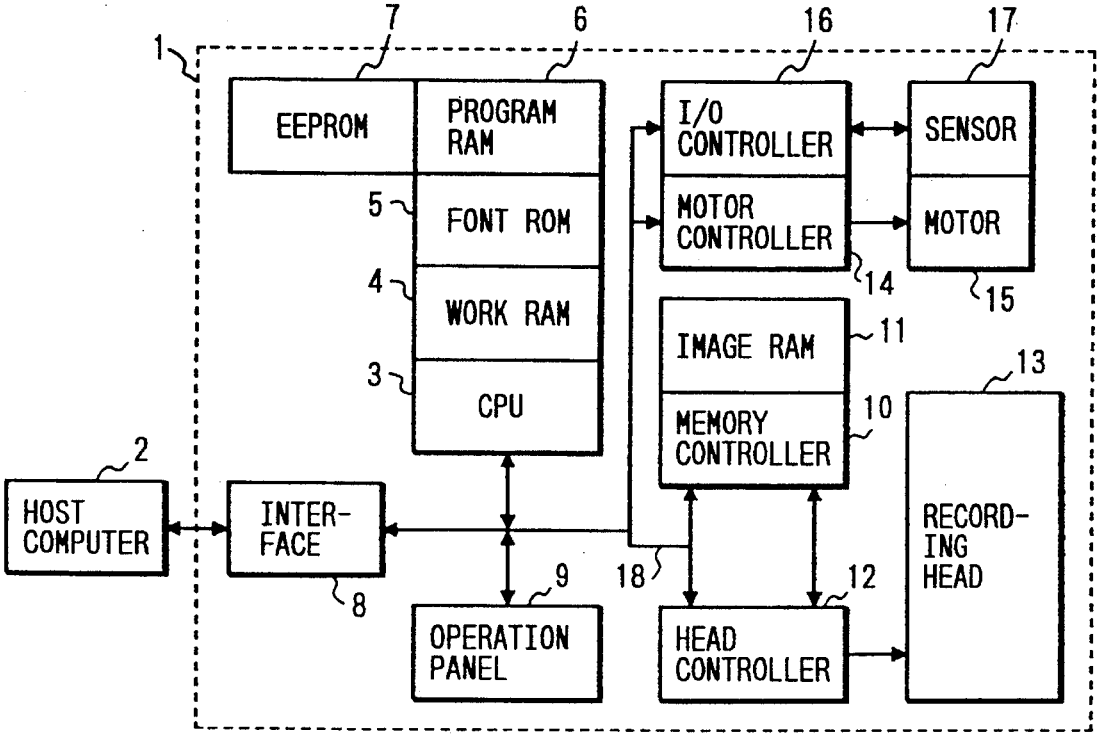
FIG. 1 is a diagram showing the system configuration of an embodiment of the ink-jet recording apparatus according to the present invention.

FIG. 1 is a diagram showing the system configuration of an embodiment of the ink-jet recording apparatus of the present invention. In the FIG. 1, reference numeral 1 denotes an ink-jet recording apparatus, 2 denotes a host computer, 3 denotes a CPU, 4 denotes a work RAM, 5 denotes a font ROM, 6 denotes a program ROM, 7 denotes an EEPROM, 8 denotes an interface, 9 denotes an operation panel, 10 denotes a memory controller, 11 denotes an image RAM, 12 denotes a head controller, 13 denotes recording heads, 14 denotes a motor controller, 15 denotes a motor, 16 denotes an I/O controller, 17 denotes sensors, and 18 denotes a common bus.

The ink-jet recording apparatus 1 is connected to the host computer 2 so that data are transmitted therebetween. The CPU 3 is connected to the work RAM 4, the font ROM 5, the program ROM 6 and the EEPROM 7. The CPU 3 operates in accordance with programs stored in the program ROM 6 while referring to preset values stored in the EEPROM 7 such as correction data for high quality recording. The CPU 3 is connected also to the common bus 18, so as to control various units of the ink-jet recording apparatus 1 via the common bus 18. The work RAM 4 is used as a work memory area for the CPU 3, and also as a memory for storing various kinds of information used in the system. The font ROM 5 stores image data of characters to be printed. The program ROM 6 stores programs for instructing the operation of the CPU 3. The EEPROM 7 is a nonvolatile memory which can retain the contents thereof even if the power is off. For this reason, various preset values such as correction data for high quality recording and operation modes of the system are stored in the EEPROM 7. In some cases, such data are set through the operation panel 9.

The interface 8 is connected to the common bus 18 and the host computer 2, so that data are directly sent to and received from the host computer 2. The operation panel 9 is connected to the common bus 18 so as to accept various inputs from the user and display various conditions and messages to the user.

The memory controller 10 is connected to the image RAM 11, the common bus 18 and the head controller 12, and controls the image RAM 11. Data to be recorded are stored in the image RAM 11 with the form of an image. The memory area of the image RAM 11 can be divided into regions respectively corresponding to the recording heads.

The head controller 12 is connected to the recording head 13, the common bus 18 and the memory controller 10, and controls the recording heads 13. The controls of the recording heads 13 include at least controls of the timing of ejecting ink from each nozzle of the recording heads, and the temperature of the ink, etc. In place of the CPU 3, the head controller 12 can perform some of the controls such as the selection of used nozzles on the basis of the nozzle selection data which will be described later. The recording heads 13 consist of a plurality of heads each having N nozzles. For example, in the case of color printing, the recording heads 13 consist of four heads for black (K), cyan (C), magenta (M), and yellow (Y).

The motor controller 14 is connected to the motor 15 and the common bus 18, and controls the motor 15. The motor 15 moves a carriage on which the recording heads 13 are mounted, in a relative manner to a recording medium, e.g., a recording sheet. The I/O controller 16 is connected to the various sensors 17 and the common bus 18, and controls the various sensors 17 and receives data detected therefrom. The sensors 17 include those for detecting, for example, the end of a recording sheet, the width of the recording sheet, and the amount of ink.

The common bus 18 connects the CPU 3, the interface 8, the operation panel 9, the memory controller 10, the head controller 12, the motor controller 14 and the I/O controller 16 to each other, to transmit various kinds of data and control signals therebetween.

With the above-described configuration, the units are separately installed so as to perform different functions. This configuration can be modified so that, for example, the image RAM 11 and the work RAM. 4 is realized with a single RAM.

The operation of the system shown in FIG. 1 will be described. The CPU 3 operates in accordance with the programs stored in the program ROM 6 while referring to the preset values and the like stored in the EEPROM 7. During the operation, the work RAM 4 is used as required. Values and the like to be stored in the EEPROM 7 are input through the operation panel 9. Furthermore, the CPU 3 receives data from the sensors 17 via the I/O controller 16. The CPU 3 checks the conditions as to whether the recording can be performed or not, and instructs the motor controller 14 to move the carriage and transport a recording sheet, thereby performing the position setting or the like for the recording.

When the host computer 2 sends out data to be recorded such as image data and character codes, the data are received by the interface 8 which in turn transfers the received data to the CPU 3. The CPU 3 converts the received data into image data suitable for the recording, e.g., a bit map, depending on the print format. For example, if the received data are character codes, the data are converted into image data of the corresponding characters by using the font ROM 5. The converted image data are stored into the image RAM 11 through the memory controller 10.

After the image data are stored, a head drive pulse width and a drive operation mode are determined based on the temperatures detected by temperature detecting elements (hereinafter referred to as "thermistor") incorporated in the printer body and in the heads, and various set values are set to the head controller 12. Particularly, a low head temperature adversely affects the ink ejection characteristics at an instance immediately before the start of the printing. In order to prevent this from occurring, an operation for raising the head temperature is performed until the head temperature reaches an optimum temperature range in which the ink ejection characteristics are relatively stable. Next, the CPU 3 instructs the motor controller 14 to move the carriage and performs the scanning operation. An encoder for generating a print timing signal is mounted on the carriage on which the recording heads 13 are mounted. The print timing signal depending on the carriage scanning speed is supplied to the CPU 3 and the head controller 12. The CPU 3 determines a printing start position on the basis of the timing signal, and provides a gate signal for enabling the printing to be started, to the head controller 12. In response to the print enable gate signal and the print timing signal, the head controller 12 outputs a head drive signal to the recording heads 13. The above operation is continuously performed. When the printing for one scan is completed, an interrupt is produced from the memory controller 10, and input into the CPU 3. Upon receiving the interrupt signal, the CPU 3 requires the motor controller 14 to transport the recording medium by a print recording width and to scan the carriage again. In this manner, the printing for one scan is repeated several times until the print recording operation for the recording medium in the transporting direction is completed. In the embodiment, the head temperature and the environmental temperature are detected before every printing for one scan, so that the head drive pulse and the drive operation mode are determined for every printing.

When the print operation for one recording medium is completed in this way, the CPU 3 requires the motor controller 14 to discharge the recording medium. At the same time, in order to prevent the ink from drying, the carriage is moved to a position where a cap member for covering the nozzle portion is provided, and the capping operation is performed. Then, the CPU 3 waits the next print operation. As a result of the above series of operations, the print operation for one recording medium is completed.

Figure 2:
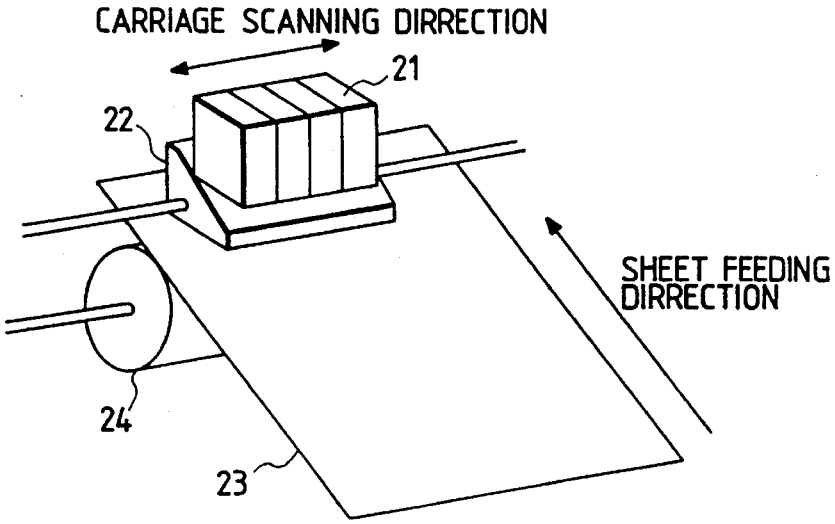
FIG. 2 is a schematic diagram showing the configuration of the vicinity of a carriage in one embodiment of the ink-jet recording apparatus according to the present invention.

FIG. 2 is a schematic diagram showing the configuration of the vicinity of a carriage in one embodiment of the ink-jet recording apparatus of the present invention. In the FIG. 2, reference numeral 21 denotes recording head units, 22 denotes a carriage, 23 denotes a recording medium, and 24 denotes a transport roller. On the carriage 22, one or a plurality of recording head units 21 are mounted in such a manner that they are detachable from the carriage 22 separately or as a single unit. Each of the recording head units 21 is provided with a plurality of nozzles. While the carriage 22 is scanned laterally, ink is ejected from the nozzles to perform the printing. In the case where a plurality of recording head units 21 are mounted on the carriage 22, ink is ejected from the recording head units 21 so that ink dots are superposed to form an image. For example, four recording heads for black, cyan, magenta and yellow can be provided for each of the recording head units 21, thereby enabling a color image to be formed.

When one scan operation of the carriage 22 is finished, the recording medium 23 is transported by a predetermined distance by the transport roller 24. This operation is repeated so as to complete the printing for one recording sheet.

In the embodiment, the movement of a recording medium in the vertical direction is conducted by moving the recording medium itself. Alternatively, the vertical movement can be achieved by moving the carriage 22. The moving distance can correspond to a printing pitch of one scanning, or a predetermined line-feed pitch. A recording medium can be moved in a single step by a distance corresponding to several scans and including a line-feed pitch for a blank line. Moreover, during the operation of feeding a recording medium, or when a recording medium is positioned for the recording in accordance with a predetermined format, for example, the recording medium can be transported in accordance with instructions from the CPU 3, and the moving distance can be varied by instructions from the host computer 2.

Figure 21:
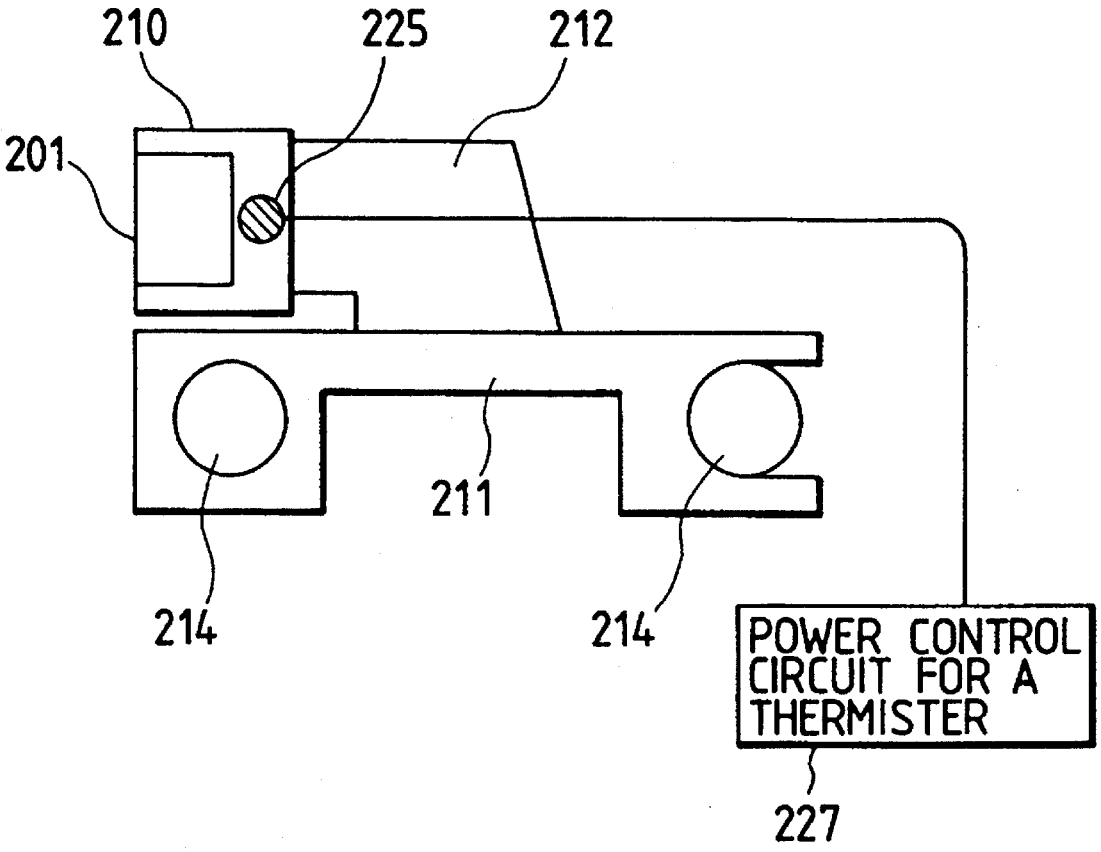
FIG. 21 is a schematic diagram showing the configuration of another embodiment of the carriage according to the present invention.

FIG. 21 is a schematic diagram showing the configuration of another embodiment of the carriage according to the present invention. In the FIG. 21, reference numeral 201 denotes a recording head, 210 denotes a head mounting member, 211 denotes a carriage, 212 denotes a projection disposed on an upper surface of the carriage, 214 denotes rods for supporting the carriage, 225 denotes a thermistor, and 227 denotes a power control circuit for the thermistor.

Figure 3:
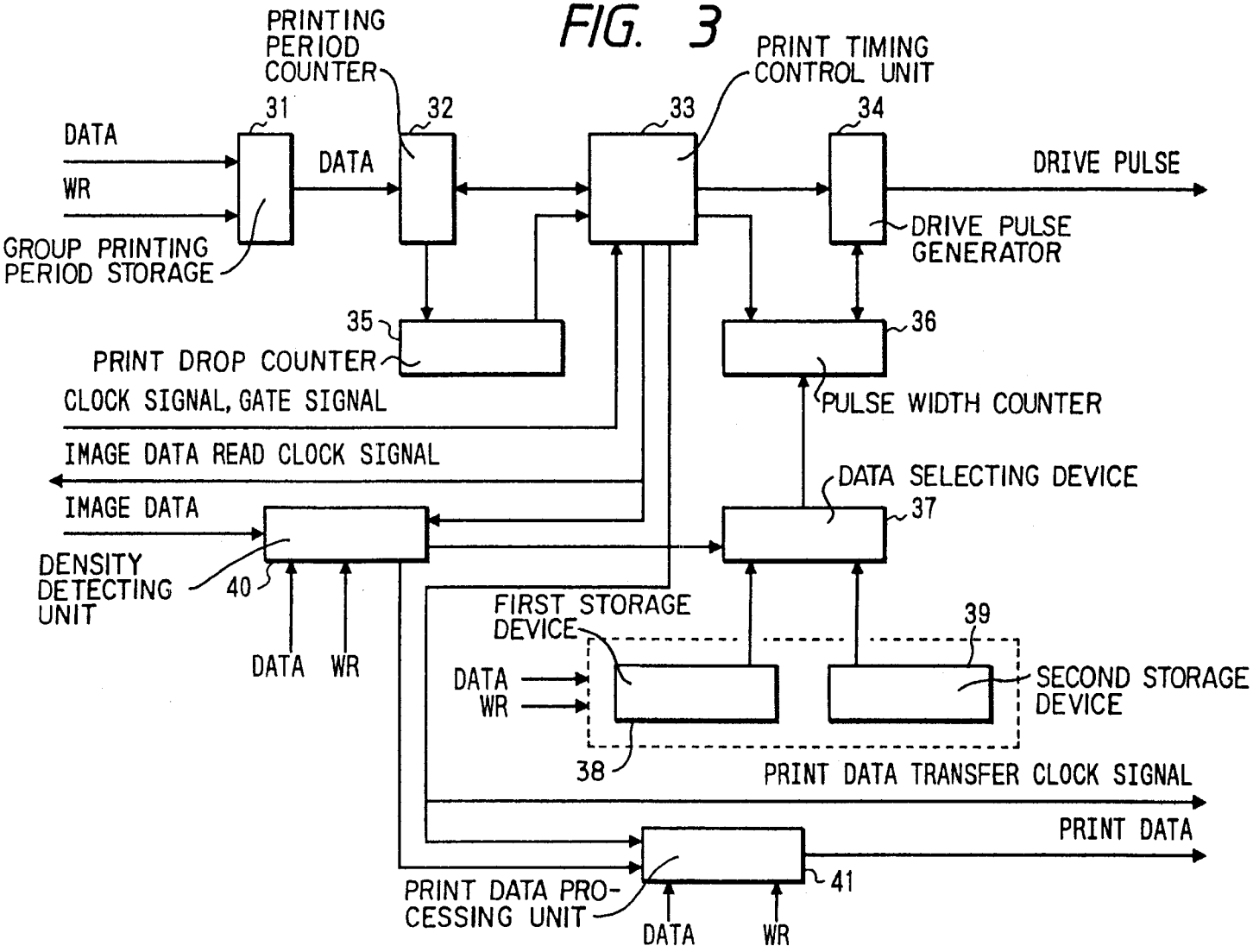
FIG. 3 is a diagram showing the configuration of an embodiment of a head drive control operation unit of the ink-jet recording apparatus according to the present invention.

FIG. 3 is a diagram showing the configuration of an embodiment of a head drive control operation unit of the ink-jet recording apparatus of the present invention. In the FIG. 3, reference numeral 31 denotes a device for storing an adjacent nozzle group printing period, 32 denotes a counter for setting an adjacent nozzle group printing period, 33 denotes a print timing control unit, 34 denotes a print drive pulse generating unit, 35 denotes a print dot number counter, 36 denotes a counter for setting a print drive pulse width, 37 denotes a data selecting device, 38 denotes a first storage device, 39 denotes a second storage device, 40 denotes an image density detecting unit, and 41 denotes a print data processing unit. The head drive control operation unit constitutes a part of the head controller 12 shown in FIG. 1. In the driving of the plurality of nozzles provided for the heads, the plurality of nozzles are divided into groups each having several nozzles, the nozzles belonging to one nozzle group are simultaneously driven, and the nozzle groups are sequentially driven. In the following description, such a nozzle group is referred to as a dividedly and simultaneously driven nozzle group.

The device 31 for storing the adjacent nozzle group printing period stores the value of an adjacent nozzle group printing period which corresponds to a time period between the dividedly and simultaneously driven nozzle groups. This value is determined on the bases of data sent from the CPU 3, etc., and set in the storage device in response to a signal WR. In accordance with instructions of the print timing control unit 33, the counter 32 for setting the adjacent nozzle group printing period generates a period time signal based on the adjacent nozzle group printing period stored in the device 31 for storing the adjacent nozzle group printing period, and sends the period time signal to the printing timing control unit 33 and the print dot number counter 35. The print dot number counter 35 which receives the period time signal from the counter 32 for setting the adjacent nozzle group print period counts the number of nozzle groups, and, when the counted number reaches the total nozzle number, informs the print timing control unit 33 of this.

The print timing control unit 33 generates various timing signals. In response to a clock signal and a gate signal from other control units, the period time signal from the counter 32 for setting the adjacent nozzle group printing period, and the signal indicative of the number of print nozzle groups from the print dot number counter 35, the print timing control unit 33 performs the following operations. The print timing control unit 33 provides a counted value fetching instruction and a count clock signal, to the counter 32 for setting the adjacent nozzle group printing period and the counter 36 for setting the print drive pulse width. The print timing control unit 33 instructs the print drive pulse generating unit 34 to start the driving. The print timing control unit 33 provides an image data read clock signal to the image density detecting unit 40, and outputs the same signal to the external. The print timing control unit 33 provides a print data transfer clock signal to the print data processing unit 41, and outputs the same signal to the print heads.

The print drive pulse generating unit 34 performs an ON/OFF control of a drive pulse for the print heads, in response to the drive start instruction from the print timing control unit 33 and the count end signal from the counter 36 for setting the print drive pulse width. The counter 36 for setting the print drive pulse width fetches the drive pulse width data selected by the data selecting device 37, in accordance with the instruction from the print timing control unit 33, and performs the count operation on the basis of the count clock signal from the print timing control unit 33 until the counted value reaches the drive pulse width data. Then, the counter 36 for setting the print drive pulse width provides an end signal to the print drive pulse generating unit 34. The data selecting device 37 selects either of the drive pulse width data stored in the first storage device 38 and that stored in the second storage device 39, depending on the image density information from the image density detecting unit 40. The first and second storage devices 38 and 39 store the drive pulse width data which are to be set in the counter 36 for setting the print drive pulse width. These data are sent from the CPU 3, etc., and stored in response to the signal WR.

The image density detecting unit 40 includes a print data buffer for storing print data which are to be subjected to one division and simultaneous driving operation, and detects the number of printing dots in the print data buffer as the print density. Image data externally provided are stored in the print data buffer in accordance with the image data read clock signal supplied from the print timing control unit 33. Moreover, a density reference value which is externally fed, e.g., from the CPU 3 is fetched in accordance with the timing of the signal WR. The density reference value is compared with the print density of the data stored in the print data buffer, and the comparison result is supplied to the data selecting device 37. The print data stored in the print data buffer are fed to the print data processing unit 41. The print data processing unit 41 receives the print data from the image density detecting unit 40 in accordance with the print data transfer clock signal supplied from the print timing control unit 33, and transfers the print data to the heads. When the information indicating that there is no data to be printed by the dividedly and simultaneously driven nozzle group is sent from the image density detecting unit 40, the print data processing unit 41 sets print data to an arbitrary position corresponding to at least one nozzle in the dividedly and simultaneously driven nozzle group. The data indicative of the number of the nozzles and the nozzle positions are sent from the CPU 3, etc., and fetched in response to the signal WR.

Figure 4:
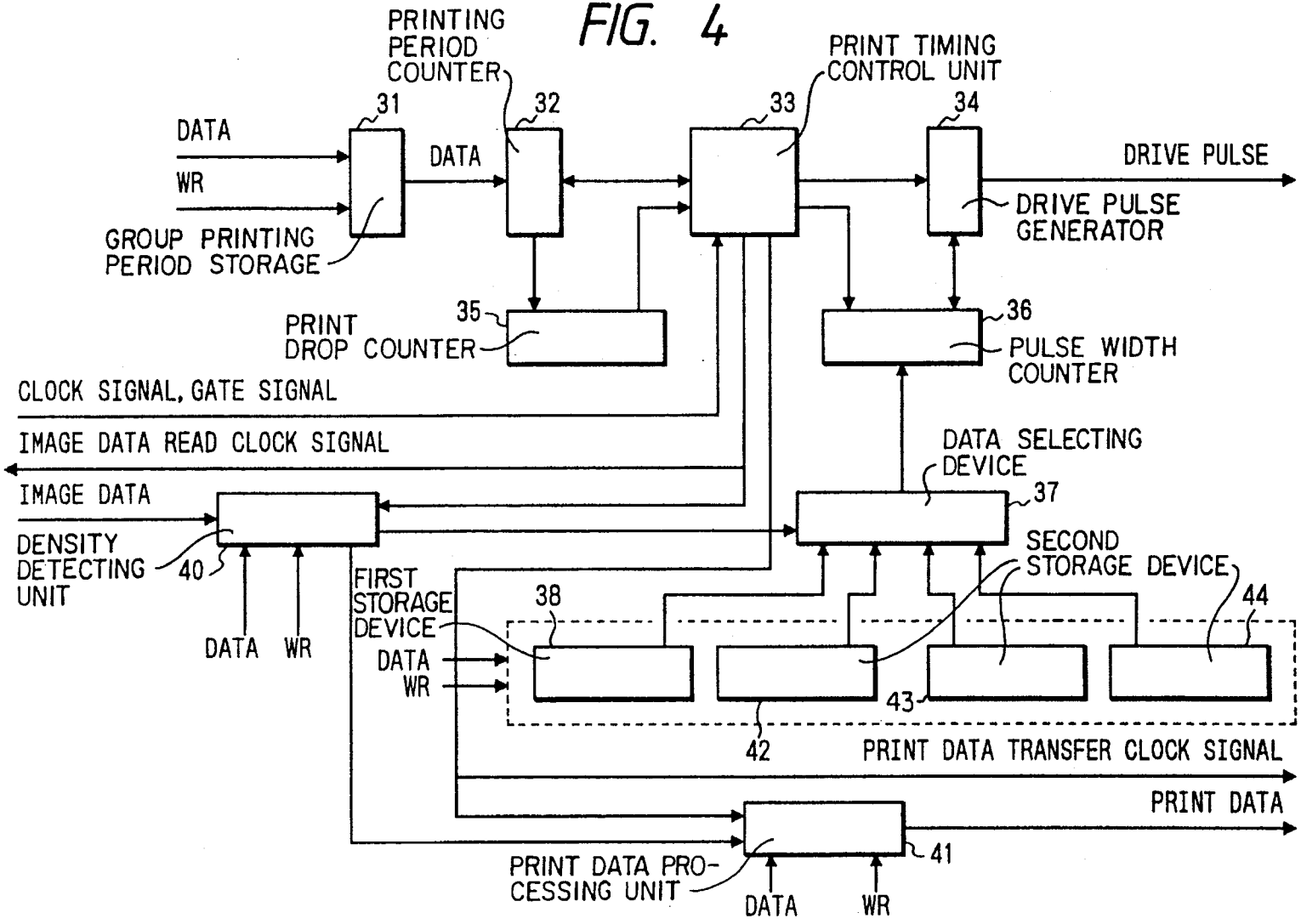
FIG. 4 is a diagram showing the configuration of another embodiment of the head drive control operation unit of the ink-jet recording apparatus according to the present invention.

FIG. 4 is a diagram showing the configuration of another embodiment of the head drive control operation unit of the ink-jet recording apparatus of the present invention. In the FIG. 4, 42, 43 and 44 denote second storage devices. Elements similar to those of FIG. 3 are denoted by the same reference numerals, and their description is omitted. The configuration shown in FIG. 4 is different from that in FIG. 3 in the configuration of the second storage device. In this embodiment, the second storage device consists of three units of second storage device 42, 43 and 44. Therefore, in the second storage device, a plurality of data pieces can be stored. In the case where such plural units of second storage device are used, the data selecting device 37 can select one among the data pieces respectively stored in the first storage device 38 and the second storage devices 42, 43 and 44.

Figure 5:
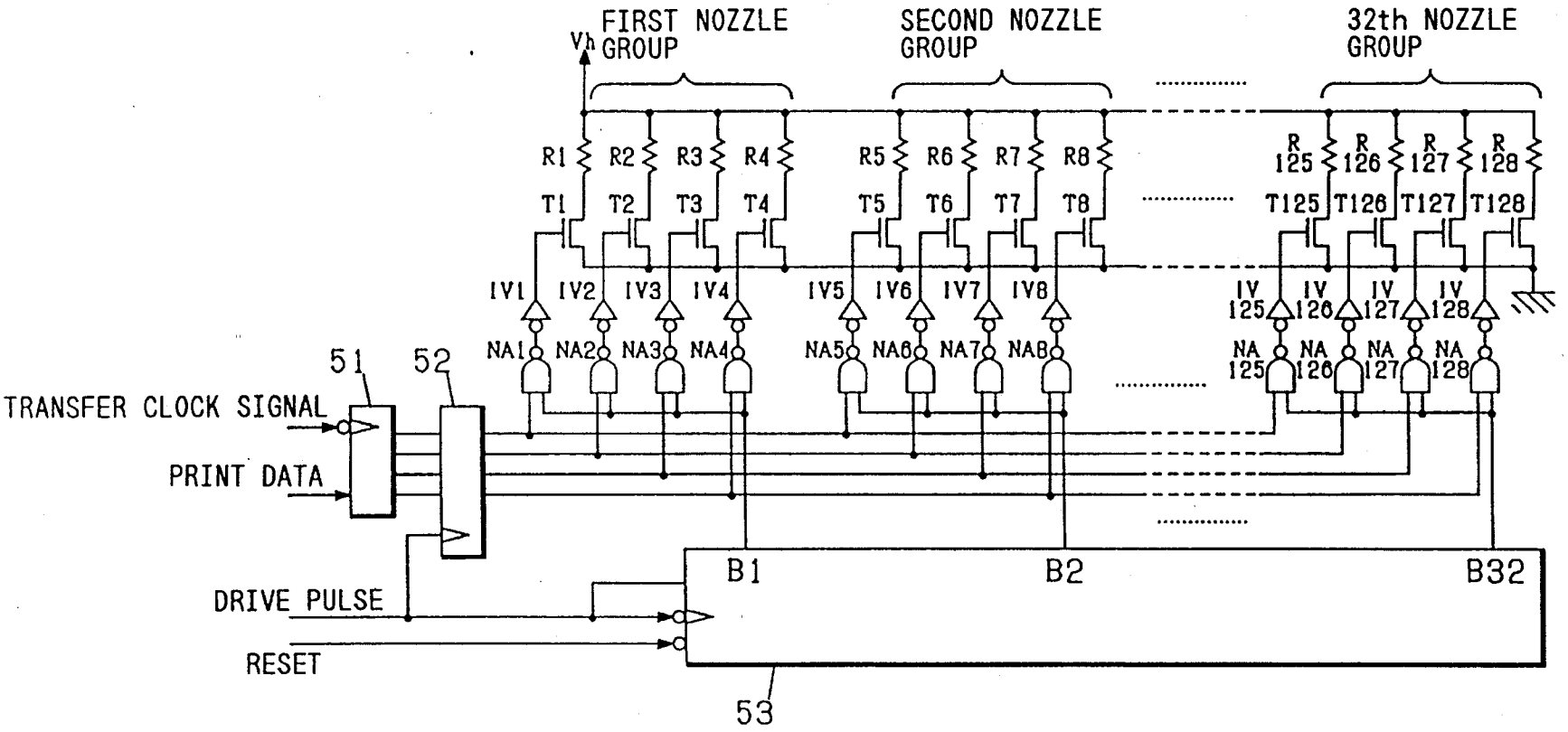
FIG. 5 is a diagram showing the configuration of an embodiment of an internal circuit of a head of the ink-jet recording apparatus according to the present invention.

FIG. 5 is a diagram: showing the configuration of an embodiment of the internal circuit of a head of the ink-jet recording apparatus of the present invention. In the FIG. 5, 51 denotes a 4-bit shift register, 52 denotes a 4-bit latch, 53 denotes a 32-bit shift register, R1 to R128 denote heaters, T1 to T128 denote switching transistors, IV1 to IV128 denote inverters, and NA1 to NA128 denote NAND circuits. In FIG. 5, the total number of the nozzles of the head is 128, and one nozzle group consists of four nozzles, or the nozzles are divided into 32 groups to be driven. The nozzles are provided with the heaters R1 to R128, respectively. One end of each of the heaters R1 to R128 is connected to a common power source. The other end of each of the heaters R1 to R128 is grounded via the corresponding one of the switching transistors T1 to T128. When one of the switching transistors is turned "ON", a current flows through the respective heater, so that the nozzle is driven. The switching transistors T1 to T128 are turned "ON" or "OFF" in accordance with a logical product signal of the drive pulse and the print data which are input to the respective NAND circuits NA1 to NA128. The logical product signals are produced by the NAND circuits NA1 to NA128 and the inverters IV1 to IV128.

The shift register 51 sequentially receives the print data from the print data processing unit 41 in synchronization with the print data transfer clock signal from the print timing control unit 33, and outputs parallel print data corresponding to the four nozzles of one nozzle group. In synchronization with the drive pulse from the print drive pulse generating unit 34, the 4-bit latch 52 temporarily stored the print data from the 4-bit shift register 51, and outputs print data toward the nozzles. The print data output from the 4-bit latch 52 are respectively input to the NAND circuits corresponding to the nozzles in each nozzle group. More specifically, a first data line from the 4-bit latch 52 is connected to the NAND circuit NA1 corresponding to the first nozzle of the first nozzle group, the NAND circuit NA5 corresponding to the first nozzle of the second nozzle group, . . . , and the NAND circuit NA125 corresponding to the first nozzle of the 32th nozzle group. The second data line is connected to the NAND circuits corresponding to the second nozzles of the nozzle groups. The third and the fourth data lines are connected to the NAND circuits in the same manner. The 32-bit shift register 53 has output lines corresponding to the nozzle groups. The output lines are sequentially switched over by the shift operation, so that one nozzle group is sequentially selected from the 32 nozzle groups, and a drive signal is supplied to the NAND circuits corresponding to nozzles of the nozzle group to be driven. The 32-bit shift register 53 receives the drive pulse from the print drive pulse generating unit 34. When the drive pulse is "H" level, the signal to the selected nozzle group is set to "H" level during this "H" period. When the drive pulse is changed to "L" level, this level change is detected, and the position of the selected output line is shifted so that the next nozzle group is driven.

FIG. 6 is a drive timing chart for nozzle groups in the head of the ink-jet recording apparatus of the present invention. When the drive pulse becomes "H" level, the drive signal is first output to the output line B1 to drive the first nozzle group, i.e., the first to fourth nozzles. The first nozzle group is driven during the "H" level period of the drive pulse, based on the drive signal and the print data latched in the 4-bit latch 52. During the driving of the first nozzle group, print data for the second nozzle group are transferred to the 4-bit shift register 51. When the drive pulse becomes "L" level, the output line through which the drive signal is to be output is shifted to the output line B2. When the drive pulse returns to "H" level thereafter, the drive signal is output through the output line B2 only during the "H" level period, to drive the second nozzle group, i.e., the fifth to eighth nozzles. At the time when the drive pulse reaches "H" level, the print data for the second nozzle group which have been transferred to the 4-bit shift register 51 are latched by the 4-bit latch 52. During the driving of the second nozzle group, the corresponding print data are output from the 4-bit latch 52. The second nozzle group is driven based on the drive signal output through the output line B2 and the print data corresponding to the second nozzle group and output from the 4-bit latch 52. In this manner, the 32 nozzle groups are sequentially driven during a time period corresponding to the drive pulse width, based on the corresponding print data.

In each of the nozzles, the drive signal from the 32-bit shift register 53 is input to one input of the NAND circuit corresponding to the nozzle, and the print data from the 4-bit latch 52 is input to the other input the NAND circuit. Accordingly, when there exists the print data for the nozzle and the drive signal is output, the output of the NAND circuit is "L" level only during the output of the drive signal. The output level is inverted to "H" level by the inverter, so that the switching transistor is turned "ON". As a result, a current flows through the heater of the nozzle, so that the nozzle is driven.

As described above, the 128 nozzles are divided into nozzle groups each having 4 nozzles, and four nozzles at the most are simultaneously driven in accordance with image data. In addition, the nozzle groups are sequentially driven in accordance with the drive pulse. As the result of the 32 drive operations of the nozzle groups, the 128 nozzles are driven.

Next, the print operation will be described. The ink-jet recording apparatus operates in different manners depending on the environmental temperature and the head temperature. In the following description of the print operation, the temperature range is divided into a higher temperature range, an optimum temperature range and a lower temperature range, and the optimum temperature range is subdivided into three grades. The three grades of the optimum temperature range are referred to as optimum temperature range A, optimum temperature range B, and optimum temperature range C, in the rising order.

First, the print control operation in the case where the ink-jet recording apparatus is located in the optimum temperature range A will be described with reference to FIGS. 1, 3 and 7.

When the data to be printed are set in the image RAM 11, the thermistor 225 detects the current head temperature. Then, an optimum print drive pulse width data T4 for the detected temperature is set in the first storage device 38. Since the current temperature is in the optimum temperature range A, the second storage device 39 is not used.

When a print gate signal and a print timing signal (clock signal) are supplied externally, the print timing control unit 33 sends a signal for setting an adjacent nozzle group printing period Tp (seconds) which is stored in the device 31 for storing the adjacent nozzle group printing period, to the adjacent nozzle group printing period setting counter 32. This signal is used also to set drive pulse width data to the counter 36 for setting the print drive pulse width. When the head temperature is in the optimum temperature range A, the operations of the print density judgment in the image density detecting unit 40 and the print data generation in the print data processing unit 41 are inhibited, and the data stored in the first storage device 38 are forcedly adopted as the drive pulse width data.

At the same time when the count clock signal from the print timing control unit 33 is input to the counter 32 for setting the adjacent nozzle group printing period and the counter 36 for setting the print drive pulse width, the print drive pulse output from the print drive pulse generating unit 34 becomes "H" level, so that a current starts to flow through the heater(s) of the head. When the counter 36 for setting the print drive pulse width finishes the operation of counting clock pulses corresponding to the preset drive pulse width data, the counter 36 for setting the print drive pulse width sends the end signal to the print drive pulse generating unit 34. Then, the print drive pulse becomes the "L" level, and the current flow through the heater(s) of the head is terminated. As a result of the above operation, a print drive pulse of T4 seconds is generated. The heater(s) generates heat for T4 seconds to form bubbles in the nozzle(s), thereby ejecting ink. Next, after counting the preset adjacent nozzle group printing period Tp, the counter 32 for setting the adjacent nozzle group printing period judges that the print control for one dividedly and simultaneously driven nozzle group is completed, and supplies one clock pulse to the print dot number counter 35 so that the print dot number counter 35 manages the current number of the print dots. An end signal is sent also to the print timing control unit 33.

The print timing control unit 33 commences the next print operation in response to the end signal from the counter 32 for setting the adjacent nozzle group printing period, and repeats the above operations. When the contents of the print dot number counter 35 reaches the value indicating the total number of the nozzles, the print timing control unit 33 is inhibited from instructing the start of printing. As a result of the above series of operations, all the nozzles have been driven. The print drive pulses which are output during the above series of operations have a pulse width of T4 seconds and an interval of Tp seconds, and their number is equal to the number of nozzle groups to be driven, The ink-jet operation is performed in this way to form an image. The series of operations is performed continuously for the scanning print width of the recording medium, and then the recording medium is transported by the distance corresponding to the nozzle width. Thereafter, these operations are repeatedly performed. In this way, the print operation for one sheet of recording medium is completed.

Figure 7:
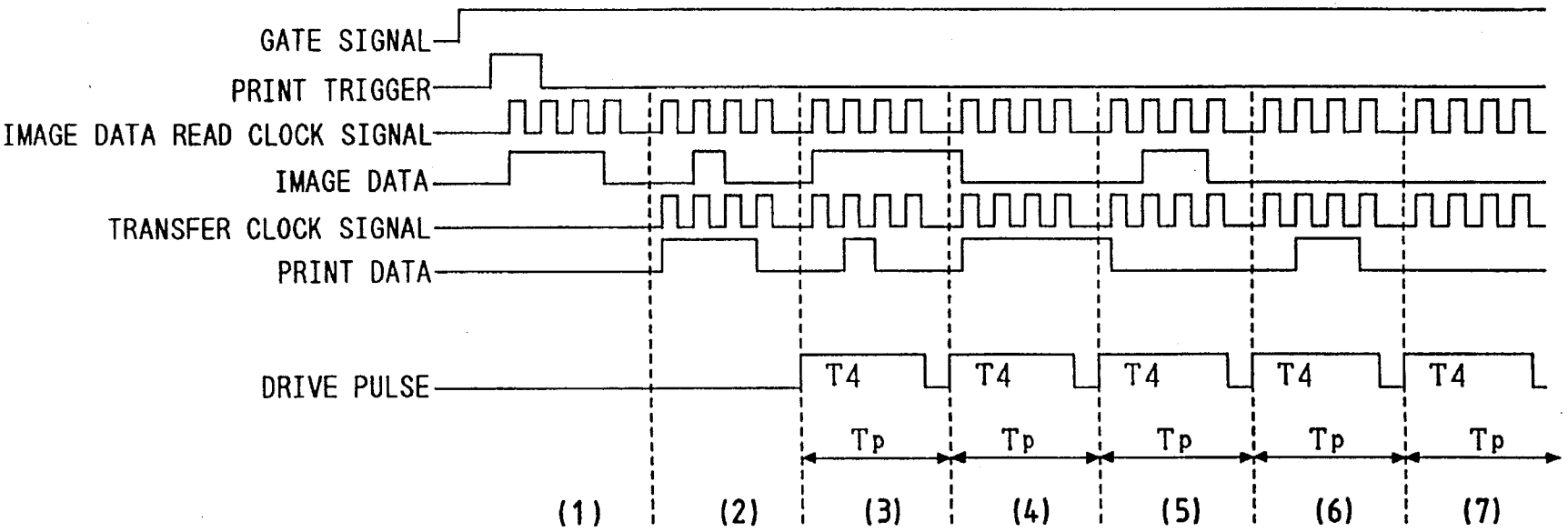
FIG. 7 is an output timing diagram of the head drive control operation unit in the case where the head temperature is in the optimum temperature range A.

FIG. 7 is an output timing diagram of the head drive control operation unit in the case where the head temperature is in the optimum temperature range A. When the gate signal is "H" level and a print trigger is input to the print timing control unit 33, the print timing control unit 33 first outputs the image data read clock signal to the memory controller 10, and the image data read clock signal is input to the memory controller 10. The memory controller 10 outputs image data in synchronization with the image data read clock signal. The image data are temporarily stored in the data buffer of the image density detecting unit 40 in synchronization with the image data read clock signal. This means that the image density detecting unit 40 reads the image data in advance.

Thereafter, the print data are output to the head through the print data processing unit 41 in synchronization with the print data transfer clock signal. The head fetches and stores the print data at the falling edge of the print data transfer clock signal, and causes a current to flow through the heater(s) of the nozzle(s) to perform the print operation, in accordance with the drive pulse from the print drive pulse generating unit 34. In this embodiment, the number of dividedly and simultaneously driven nozzles is 4. Therefore, the timing at which the drive pulse is applied is selected so as to be after the 4-bit print data is transferred to the register in the head. For example, in state (1), the print data are read in advance by the image density detecting unit 40, and the print data are transferred in state (2) from the image density detecting unit 40 to the head through the print data processing unit 41. In state (3), the printing is actually performed by ejecting ink.

In the ink ejection operation, the nozzle groups are sequentially driven starting from the group at one end and progressing in one direction. For example, in state (3), the first set of four nozzles, i.e., the first to fourth nozzles are simultaneously driven, and, in state (4), the next set of four nozzles, i.e., the fifth to eighth nozzles are simultaneously driven. Thus, in the case where, for example, 128 nozzles are provided in total, the simultaneous driving of four nozzles is performed 32 times, whereby all the nozzles can be driven.

Next, the print control operation in the case where the ink-jet recording apparatus is located in the optimum temperature range B will be described with reference to FIGS. 1, 3 and 8. When the head temperature is in the optimum temperature range B, the drive pulse width data of T3 (seconds) which is optimum for the optimum temperature range B is stored in the first storage device 38. A drive pulse width data of T3' (seconds) for generating a pulse shorter than T3 seconds is stored in the second storage device 39. Then, the print density judging operation of the image density detecting unit 40 is enabled. The image density detection unit 40 detects the number of nozzles to be driven for the printing in one dividedly and simultaneously driven nozzle group. When the number of nozzles to be driven for the recording is N or more, the image density detecting unit 40 instructs the data selecting device 37 to select the drive pulse width data of T3' seconds stored in the second storage device 39, in order to suppress the heat accumulation. When the number of nozzles used for the recording is less than N, the image density detecting unit 40 instructs the data selecting device 37 to select the drive pulse width data of T3 seconds stored in the first storage device 38, in order to prevent the head temperature from falling. Thus, in this temperature range, the head temperature is controlled so as to be kept as constant as possible. The reference value N used in the judgments can be set by the CPU 3 or the like. Therefore, the head temperature can be controlled so as to be constant in accordance with the set value. In other words, if N is set to be a smaller value, the heat accumulation can be further suppressed, and, if N is set to be a larger value, the temperature can be prevented from drastically falling. This control functions very effectively. The other units are controlled in the same manner as those in the case where the head temperature is in the optimum temperature range A.

Figure 8:
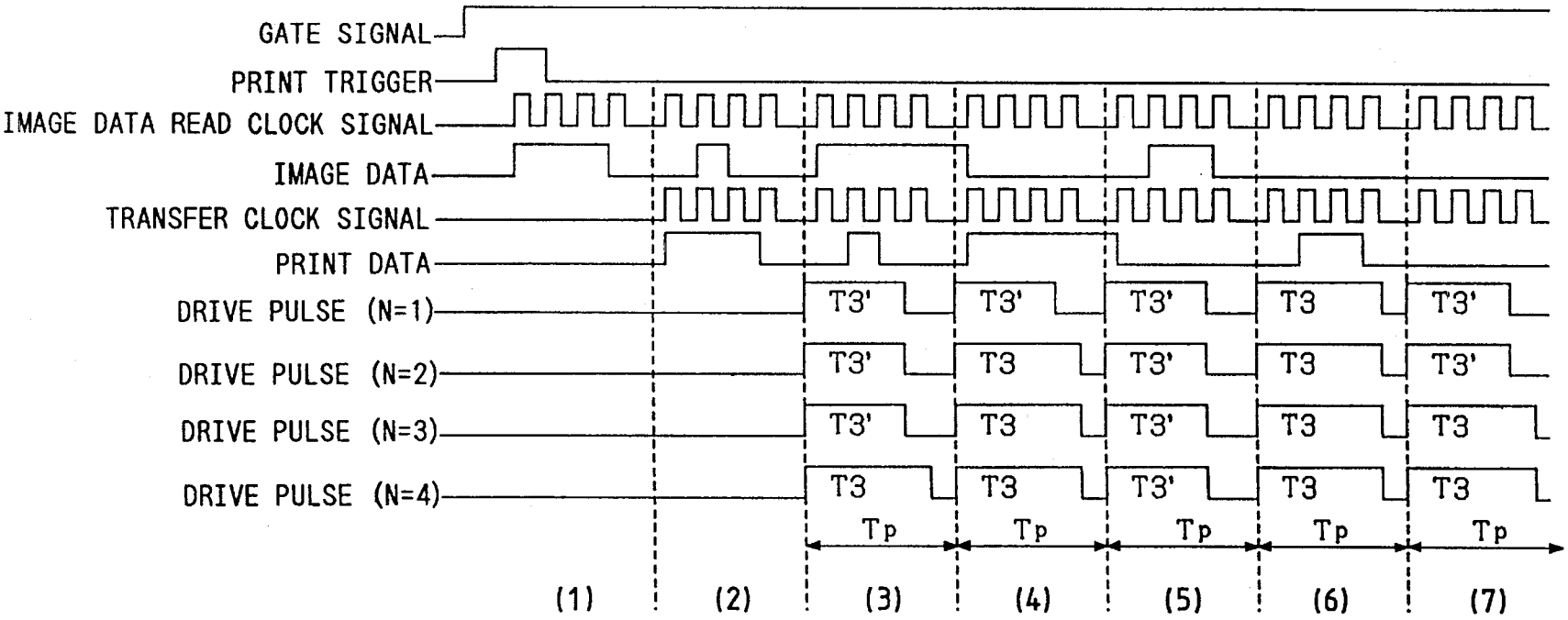
FIG. 8 is an output timing diagram of the head drive control operation unit in the case where the head temperature is in the optimum temperature range B.

FIG. 8 is an output timing diagram of the head drive control unit in the case where the head temperature is in the optimum temperature range B. FIG. 8 shows also the variation of the drive pulse width obtained when the selection reference value N is changed. As described in conjunction with FIG. 7, the number of the dividedly and simultaneously driven nozzles is 4.

In FIG. 8, the numbers of data pieces which are read in advance in states (1) to (5) are 3, 1, 4, 0 and 2, respectively. It is assumed that the reference value N is set to be 1. In the case of 3 pieces of print data, the number of the print data exceeds the value of 1, and therefore the drive pulse width data in the second storage device 39 is selected. Therefore, in state (3), the print data which have been read in advance in state (1) are printed with the pulse width T3'. In states (4) to (7), the heads are driven in a similar manner by pulse widths T3', T3', T3 and T3', respectively, to perform the printing. Also, in the case where the reference value N is 2, 3 or 4, either of the drive pulse width data of T3 and T3' is selected based on the print data which are read in advance, and a drive pulse is generated.

As seen from the above example, if N is set to be a small value, the smaller drive pulse width stored in the second storage device 39 is selected as the drive pulse width more frequently. Therefore, the energy applied to the heads can be reduced, and the heat accumulation can be suppressed. In contrast, if N is set to be a large value, the larger drive pulse width stored in the first storage device 38 is selected more frequently. Therefore, the energy applied to the heads can be made close to the normal level, and the temperature fall can be prevented from occurring.

The print control operation in the case where the ink-jet recording apparatus is located in the optimum temperature range C will be described with reference to FIGS. 1, 3 and 9. When the head temperature is in the optimum temperature range C, a drive pulse width data of T2 seconds is stored in the first storage device 38, and a drive pulse width data of T2' seconds for generating a shorter pulse than T2 seconds is stored in the second storage device 39. The image density detecting unit 40 operates in the same manner as in the case of the optimum temperature range B. Since the optimum temperature range C is higher than the optimum temperature range B, however, the reference value N is set to be the minimum value so as to enhance the heat accumulation suppression. The controls for the other units are the same as those in the optimum temperature range B.

Figure 9:
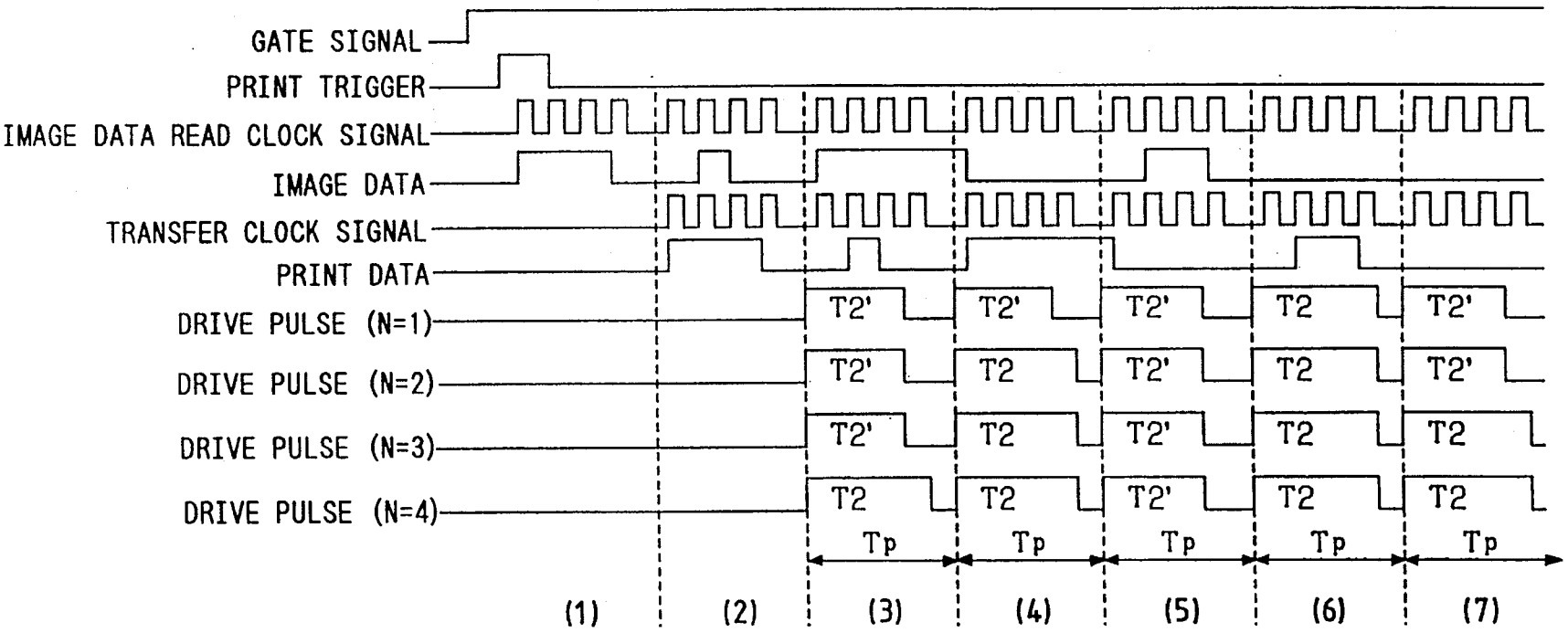
FIG. 9 is an output timing diagram of the head drive control operation unit in the case where the head temperature is in the optimum temperature range C.

FIG. 9 is an output timing diagram of the head drive control unit in the case where the head temperature is in the optimum temperature range C. The timing is substantially the same as that shown in FIG. 8, except that the drive pulse widths are T2 and T2'. Although FIG. 9 shows the drive pulses for the reference values N of 1 to 4, it is preferable, as described above, to set the reference value N for the optimum temperature range C to be as small as possible.

The print control operation in the case where the head temperature is in the higher temperature range will be described. When the head temperature is in the higher temperature range, a drive pulse width data of T1 seconds is stored in the first storage device 38, and a drive pulse width data of T1' seconds for generating a shorter pulse than T1 seconds is stored in the second storage device 39. The reference value N in the image density detecting unit 40 is set to be the minimum value. In this temperature range, the ink ejection is not stable. In order to reduce the head temperature, the print data for one print area are subjected to a plurality of scan print operations in a division manner, thereby forming a print image. Furthermore, other measures for forcibly lowering the head temperature are taken. An example of such measures is to lower the frequency of driving the same nozzle.

Next, the case where the head temperature is in the lower temperature range will be described. First, in order to stabilize the ink ejection characteristics, the head temperature is raised to the optimum temperature range B, and the print operation is then started. When the print operation is continuously performed and hence the head temperature gradually rises, the temperature control in the optimum temperature range B is performed in accordance with the above-described series of operations. If the print image density is relatively high, it is difficult to cause the head temperature to fall even under a low temperature environment, and the temperature rising may occur in some cases. In contrast, when the print image density is extremely low, the head temperature falls to the lower temperature range during the print operation, in spite that the head temperature has been raised to the optimum temperature range B before the start of the print operation. This may cause the ink ejection failure, the density variation or the like to occur. According to the configuration of the present invention, even in such a case, the control effectively functions so that the head temperature can be kept in the optimum temperature range during the print operation.

When the head temperature is positioned in the optimum temperature range B by, for example, heating the head before the start of the print operation, the drive pulse width data of T3 seconds is stored in the first storage device 38, and the drive pulse width data of T3' seconds for generating a shorter pulse than T3 seconds is stored in the second storage device 39, in the same manner as in the above-described case where the environmental temperature is in the optimum temperature range. In addition, the detecting operation of the image density detecting unit 40 is enabled. When the environmental temperature is low, however, the reference value N is set to be the maximum value in order to prevent the head temperature from falling. Alternatively, larger values may be used as the drive pulse width data set in the first and second storage devices 38 and 39. The other units are controlled in the same manner as those in the above-described case where the head temperature is in the optimum temperature range B.

Figure 10:
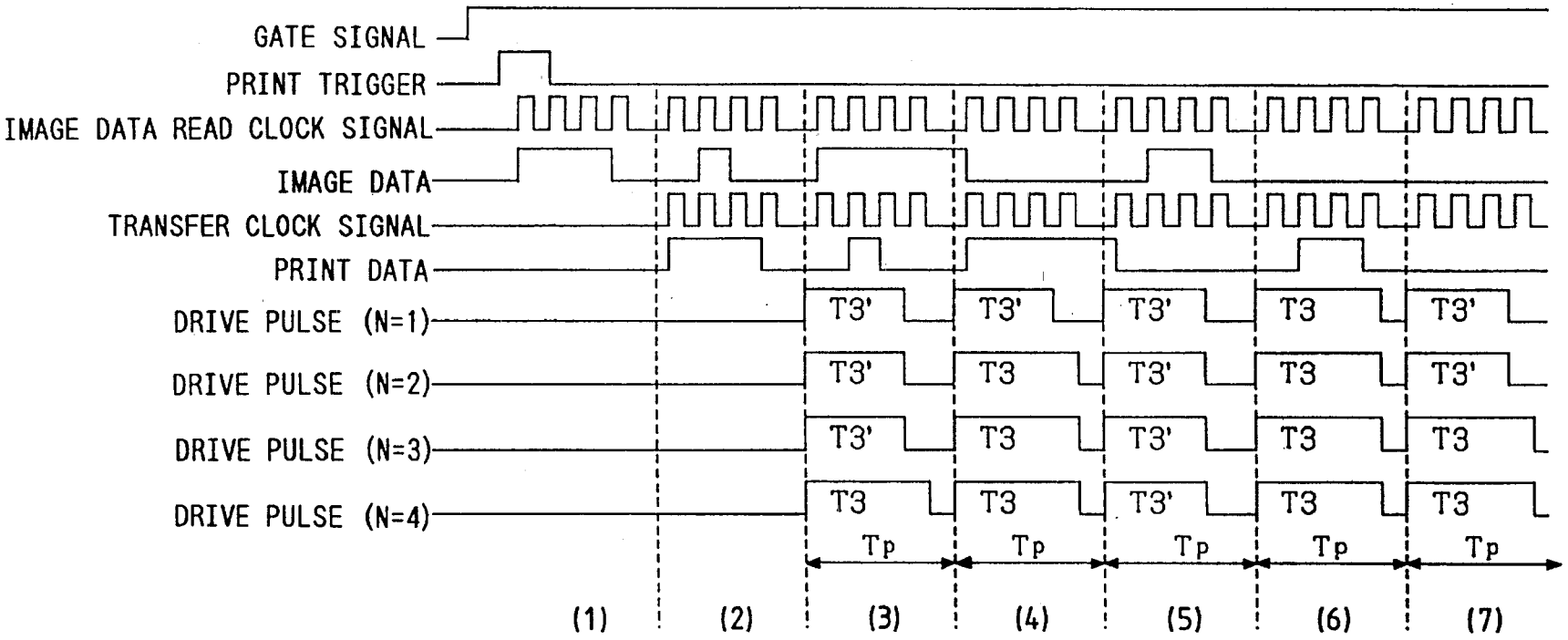
FIG. 10 is an output timing diagram of the head drive control unit in the case where the head temperature is in the optimum temperature range B under a low environmental temperature condition.

FIG. 10 is an output timing diagram of the head drive control unit in the case where the head temperature is in the optimum temperature range B under a low environmental temperature condition. The timing is substantially the same as that in FIG. 8. Although FIG. 10 shows the drive pulses for the reference values N of 1 to 4, it is preferable, as described above, to set the reference value N to be as large as possible.

A case where the head temperature gradually falls to the optimum temperature range A in spite of performing such a print control will be described.

In the above-mentioned case where the environmental temperature is the optimum one, when the head temperature reaches the optimum temperature range A, the detecting operation of the image density detecting unit 40 is inhibited, and the heads are driven based on the drive pulse width data stored in the first storage device 38. In the case where the environmental temperature is in the lower temperature range, there is a probability that the head temperature falls further even after the above operations. Accordingly, in the case where the environmental temperature is in the lower temperature range, the image density detecting unit 40 sends a control signal to the data selecting device 37. In response to the control signal, if data for at least one nozzle in one dividedly and simultaneously driven nozzle group are set, the data selecting device 37 selects the drive pulse width data stored in the first storage device 38, and, if there is no data to be printed in the nozzle group, the data selecting device 37 selects the drive pulse width data stored in the second storage device 39. This selection switching can be readily performed by, for example, operating software switches in accordance with instructions from the CPU 3, etc. In addition, the print data generating operation by the print data processing unit 41 is permitted. In the non-print operation, a drive pulse width data of T4 seconds is stored in the first storage device 38, and a drive pulse width data of T0 seconds by which ink is not ejected is stored in the second storage device 39.

If a case where there is no print data for a dividedly and simultaneously driven nozzle group occurs during the print operation, the image density detecting unit 40 sends a print data production request signal to the print data processing unit 41. The print data processing unit 41 generates print data for one or more arbitrary nozzles in the dividedly and simultaneously driven nozzle group. The print data are transferred to the head in synchronization with the transfer clock signal. At the same time, the image density detecting unit 40 sends a control signal to the data selecting device 37 so that the data stored in the second storage device 39 is selected. By these operations, the nozzle group can be driven with the drive pulse width T0 by which ink is not ejected. Thus, the head temperature can surely be prevented from falling without performing unnecessary ink ejection. Moreover, the print data processing unit 41 can control the number of print data pieces to be generated and the nozzle positions, based on the control commands from the CPU 3, etc. Accordingly, by changing these data, the temperature rise control of the head can readily be performed without changing the drive pulse.

Figure 11:
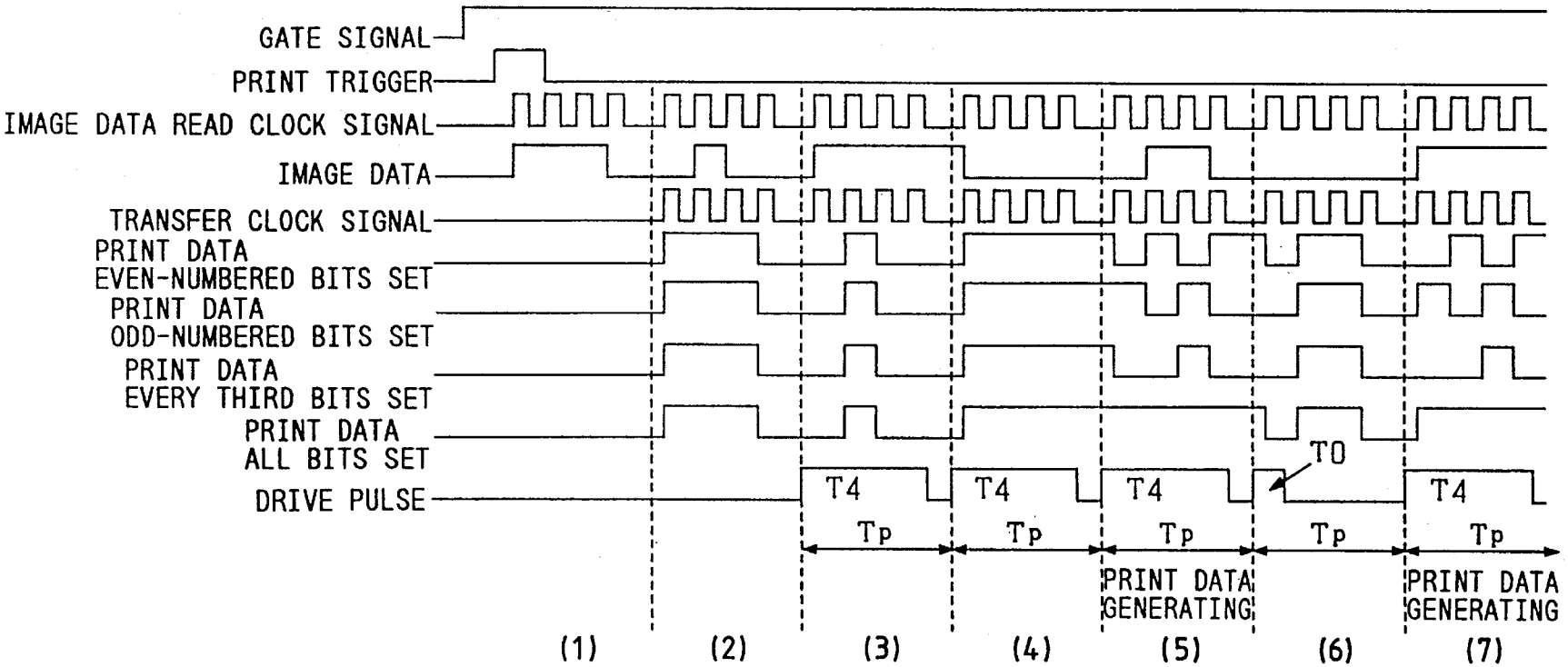
FIG. 11 is an output timing diagram of the head drive control unit in the case the head temperature falls to the optimum temperature range A under the low temperature environment.

FIG. 11 is an output timing diagram of the head drive control unit in the case the head temperature falls to the optimum temperature range A in the temperature environment.

The image data which are read in advance in states (1), (2), (3), (5) and (7) include data to be printed by at least one nozzle. Therefore, the image density detecting unit 40 instructs the data selecting device 37 to select the drive pulse width data stored in the first storage device 38. As a result, the generated drive pulse has a width of T4 seconds in states (3), (4), (5) and (7).

The image data which are read in advance in states (4) and (6) include no data to be printed. Accordingly, in states (5) and (7) in which the image density detecting unit 40 transfers the print data to the heads, the print data processing unit 41 generates various pieces of print data in accordance with the control commands, and then outputs the generated print data to the heads in synchronization with the transfer clock signal. The image density detecting unit 40 requests the data selecting device 37 to select the drive pulse width data stored in the second storage device 39. In state (6), the drive pulse width data of T0 seconds by which ink is not ejected is output to heat the portion where the fourth nozzle group is located. Though not shown in FIG. 11, the drive pulse width data of T0 seconds is also output in state (8) to heat the portion where the sixth nozzle group is located. Since the nozzle position and the number of nozzles to be heated can be readily set as described above, the head temperature can be controlled, and also the temperature variation between nozzles can be controlled. As examples of the nozzle position and the number of nozzles which can be set, FIG. 11 shows four types of print data timings for driving only even-numbered bits, driving only odd-numbered bits, driving every third bits, and driving all the bits. It is appreciated that other bit drive patterns may be performed.

However, in the above operations, as far as there exists data of any bit number for the dividedly and simultaneously driven nozzle group, the data which is stored in the second storage device 39 and by which ink is not ejected is not adopted. In some cases, therefore, the temperature rising operation of the nozzles during the print operation may be insufficient. For example, in the case where the number of nozzles in one dividedly and simultaneously driven nozzle group is too large, the lowest print image density is lowered further, and therefore it may be difficult to raise the temperature of the whole head by the heat generated by driving several nozzles. In a usual ink-jet head capable of performing a high-speed drive, however, the drive pulse width is small and the applied voltage is set to be higher. Therefore, the power consumption per nozzle is relatively large. In addition, due to the limit of the power source capacity, the number of nozzles in one dividedly and simultaneously driven nozzle group is generally about 4 to 16. Under such conditions, the above problem does not occur.

Figure 12:
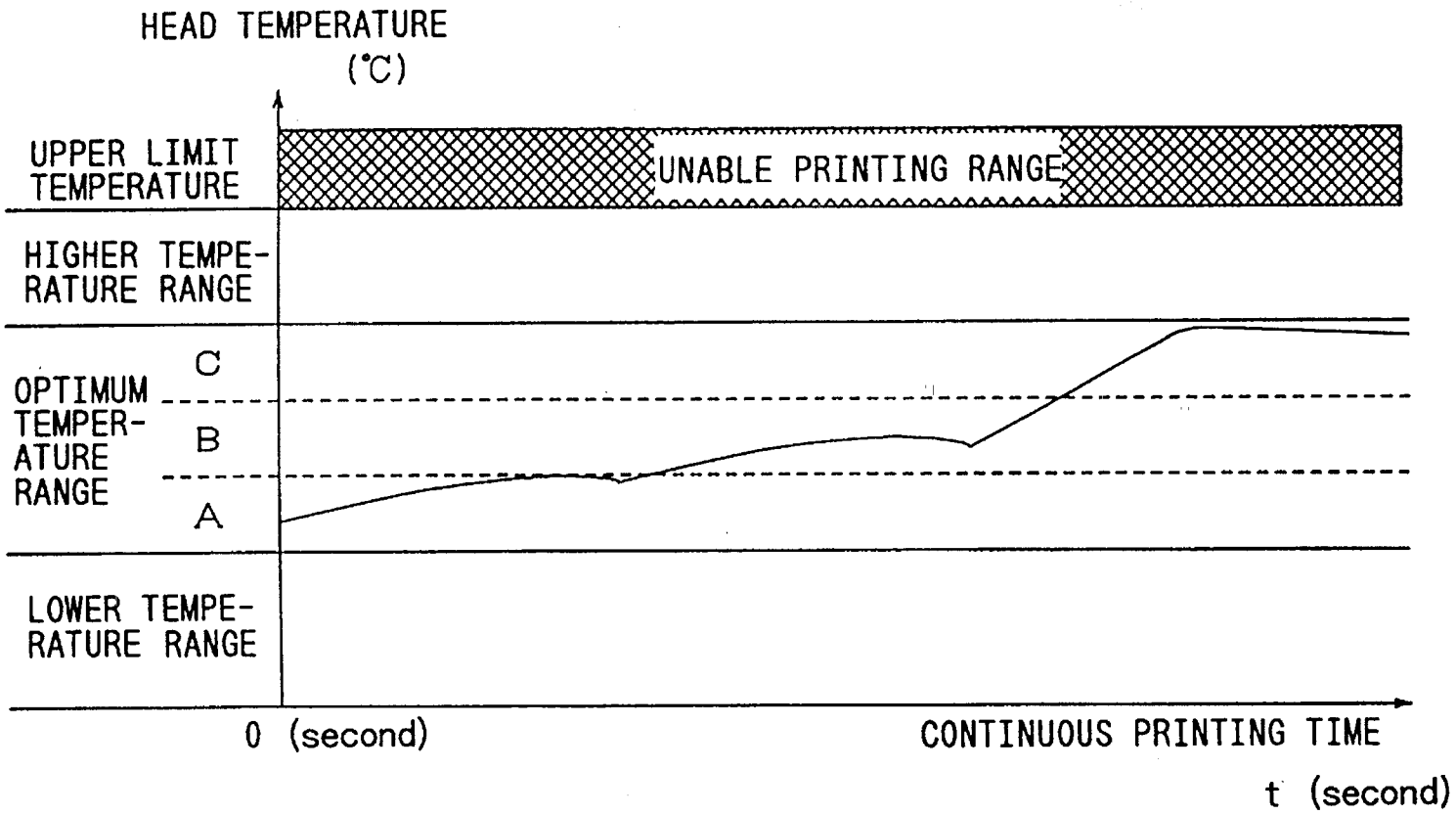
FIG. 12 is a diagram showing the temperature rising tendency of the head under an environment in the optimum temperature range.
Figure 13:
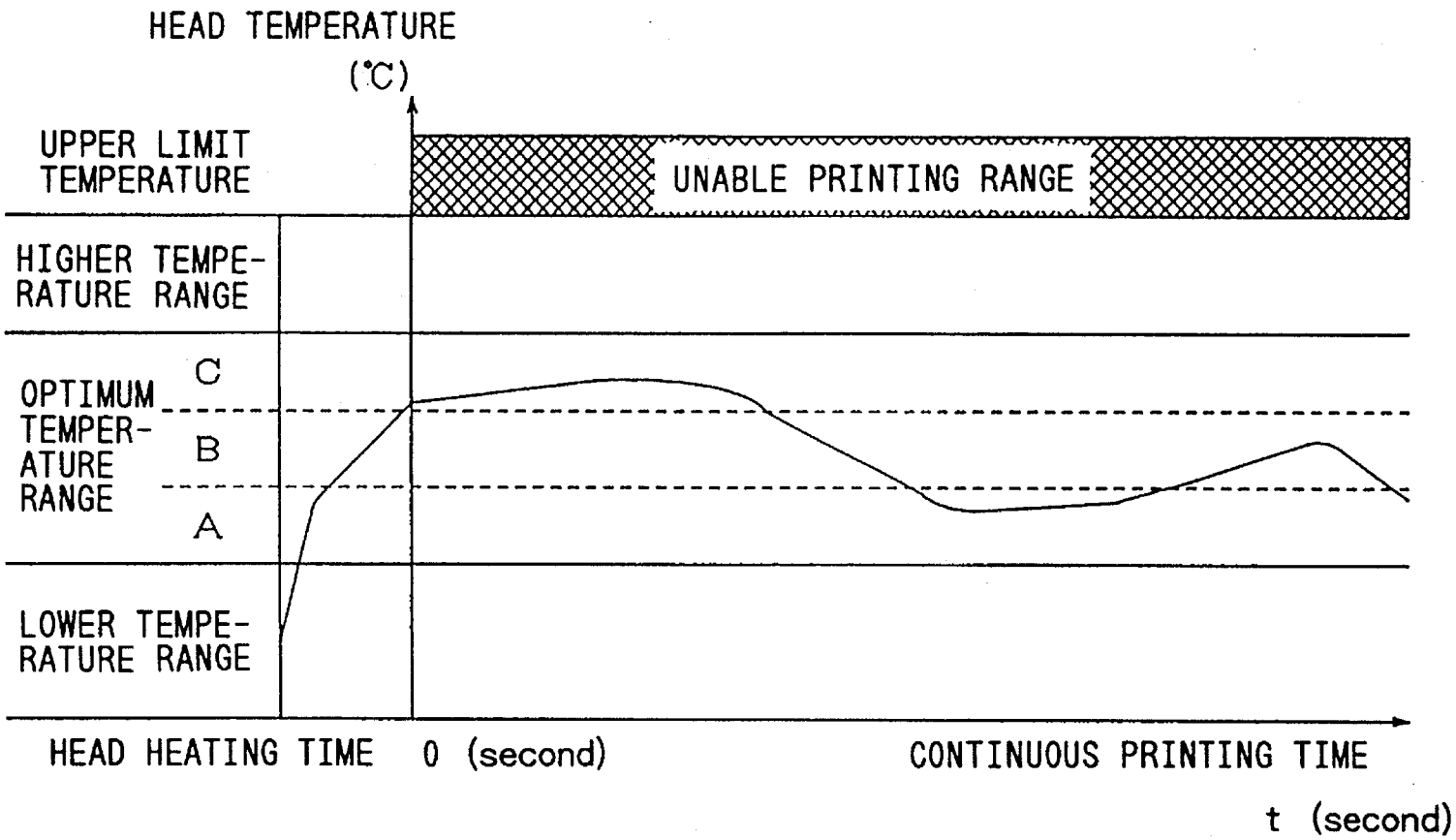
FIG. 13 is a diagram showing the temperature rising tendency of the head under a lower temperature environment.

In the above description, the head driving operations for various combinations of the environmental temperature and the head temperature has been described. However, when such print operations for various temperatures are continuously performed and, for example, a plurality of sheets are continuously printed, the balance of the energy applied to the head and the thermal energy dissipated from the heat sink of the head cartridge is lost. Accordingly, heat is accumulated in the heat sink, or heat is dissipated too much, so that the head temperature gradually rises or falls. FIGS. 12 and 13 show examples of the temperature variation in the case where the print operation is continuously performed.

FIG. 12 is a diagram showing the temperature rising tendency of the heads under an environment of the optimum temperature range.

As shown in FIG. 12, the head temperature immediately before the start of the print operation is in the optimum temperature range A, or equal to the environmental temperature. By repeating the print operation, the head temperature gradually rises to the optimum temperature range B. If the print operation is repeated further, the head temperature becomes in the optimum temperature range C. Therefore, according to the present invention, the control operations are suitably performed for the head temperature in the optimum temperature range B and in the optimum temperature range C, respectively.

FIG. 13 is a diagram showing the temperature rising tendency of the heads under a lower temperature environment. Before the start of the print operation, the head is heated to the optimum temperature range B. Then, the print operation is started. In some cases, the head temperature may fall to the optimum temperature range A during the print operation. According to the present invention, even in such a case, the beads are heated again by the temperature control so that the head temperature is always kept in the optimum temperature range.

Hereinafter, the above-mentioned temperature control operations for the temperature ranges are summarized, and the temperature operations corresponding to the temperature variation are described. FIGS. 14 to 20 are flowcharts illustrating exemplary temperature control operations in the ink-jet recording apparatus of the present invention. The operations are described referring also to FIGS. 1 and 3.

In S61, the ink-jet recording apparatus is actuated. The data to be printed are fed from the host computer 2 or the like to the image RAM 11 to be set therein. Then, in S62, the thermistor 225 detects the current head temperature. Thereafter, in S63 to S66, it is judged to which temperature range the detected temperature belongs. The process corresponding to the judged temperature range will be performed.

Figure 15:
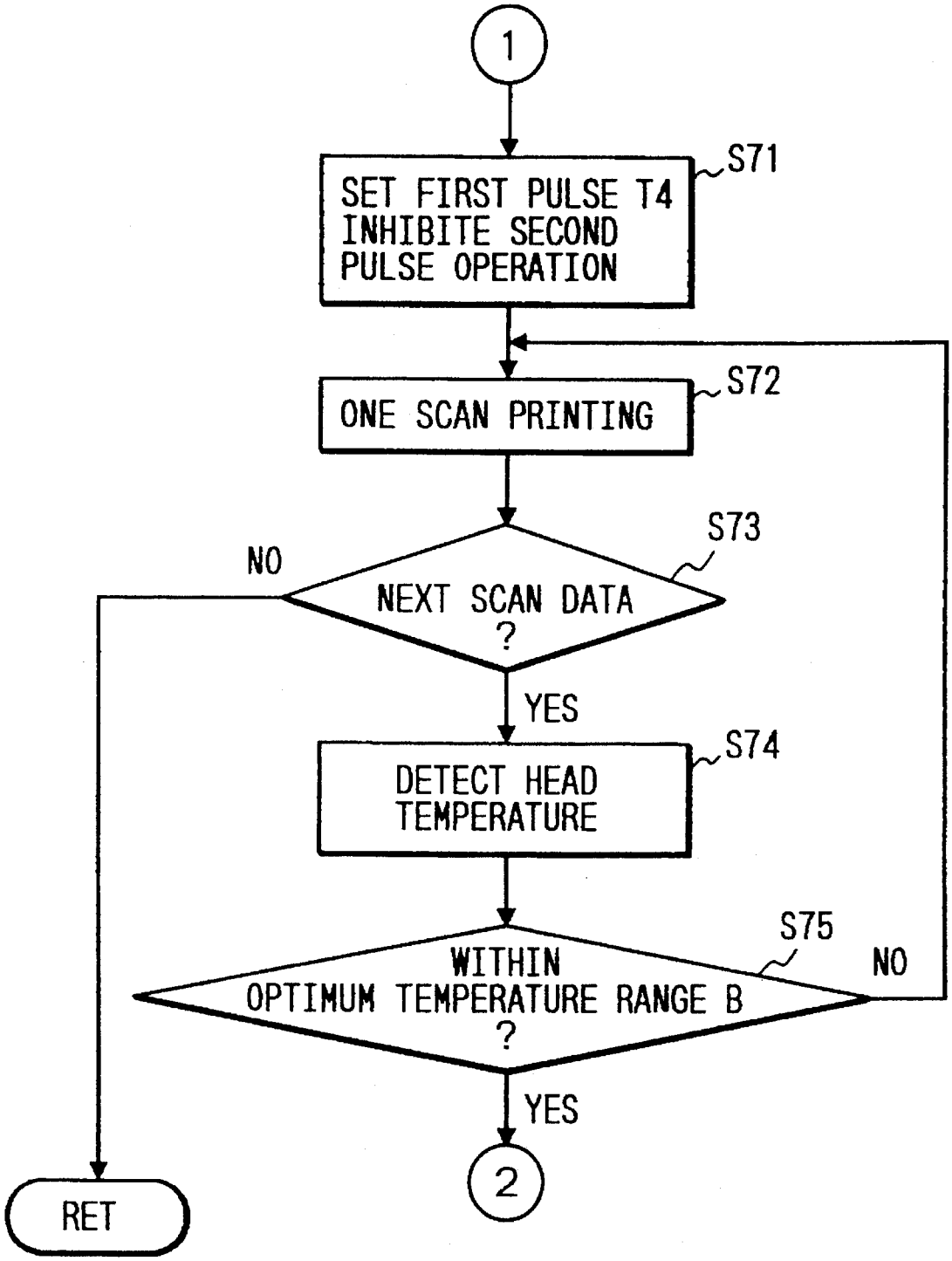

First, the operations in the cases where the current head temperature is judged in S64 to belong to the optimum temperature range A and where the head temperature falls from the optimum temperature range B to the optimum temperature range A will be described with reference to FIG. 15. In the case where the current head temperature is in the optimum temperature range A, the print drive pulse width data of T4 which is optimum for this temperature range is set in the first storage device 38 in S71. In the case where the head temperature is in the optimum temperature range A, the print density judgment operation in the image density detecting unit 40, and the print data generating operation in the print data processing unit 41 are inhibited, and the data stored in the first storage device 38 is forcedly adopted as the drive pulse width data. In this case, the second storage device 39 is not used.

In S72, the printing for one scanning is performed in the same manner as that in the optimum temperature range A which is described above. In S73, it is judged whether or not there is data to be printed next. If there is no data, the recording operation and the temperature control operation are terminated. If there is data to be printed next, the head temperature in each scanning is detected in S74. In S75, it is judged whether or not the head temperature rises to the optimum temperature range B. If the head temperature remains in the optimum temperature range A, the process returns to S72, and the print operation is repeated. If the head temperature is raised to the optimum temperature range B by the heat generation due to the ink ejection, the temperature control operation is shifted to that for the optimum temperature range B, and the temperature control is continued. In the case where the environmental temperature is in the optimum temperature range A, the head temperature may be raised by the heat generation, but the head temperature will not fall below the environmental temperature. Therefore, it is not required to consider a case where the head temperature falls to the lower temperature range.

Figure 14:
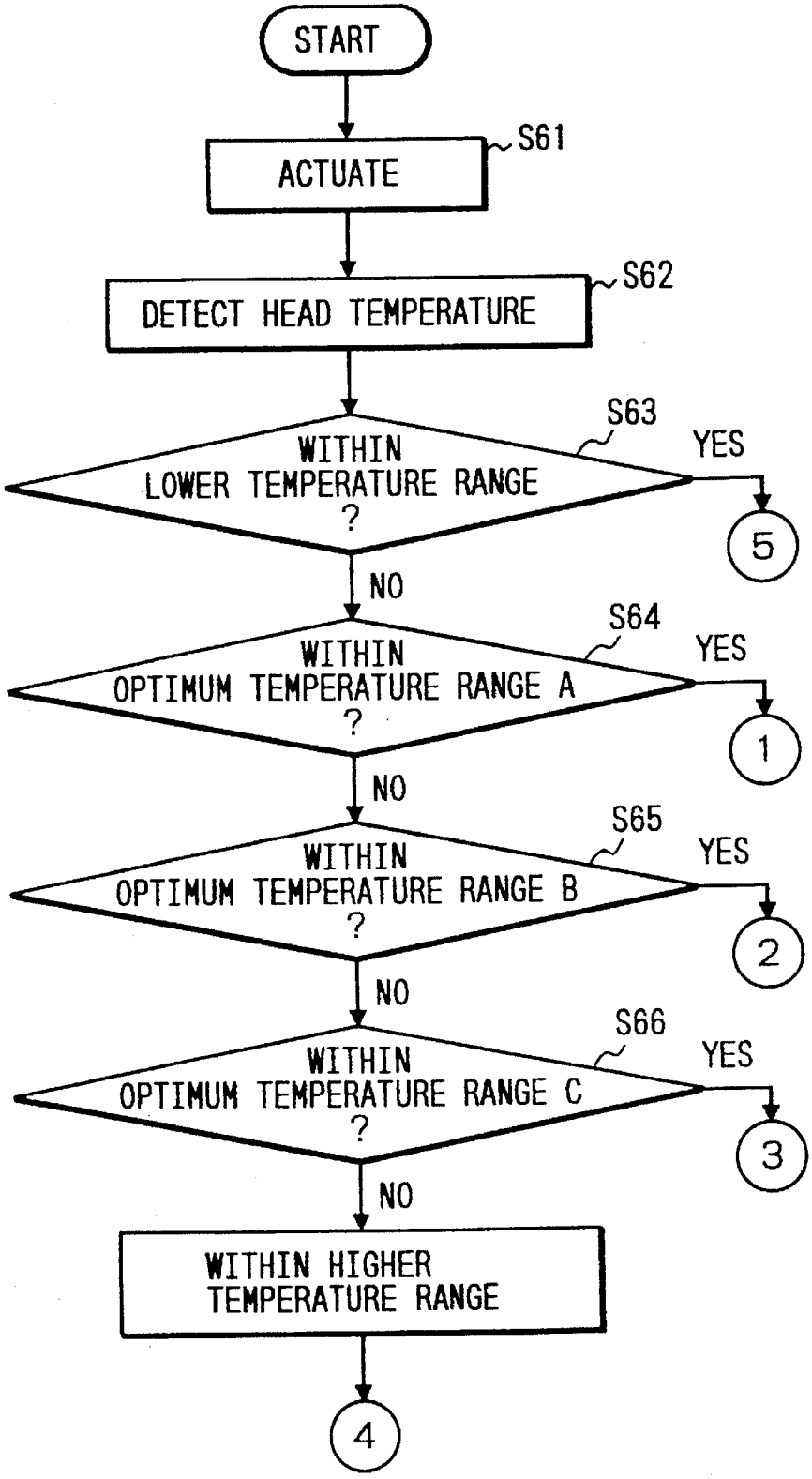
FIGS. 14 to 20 are flowcharts illustrating exemplary temperature control operations in the ink-jet recording apparatus according to the present invention.
Figure 16:
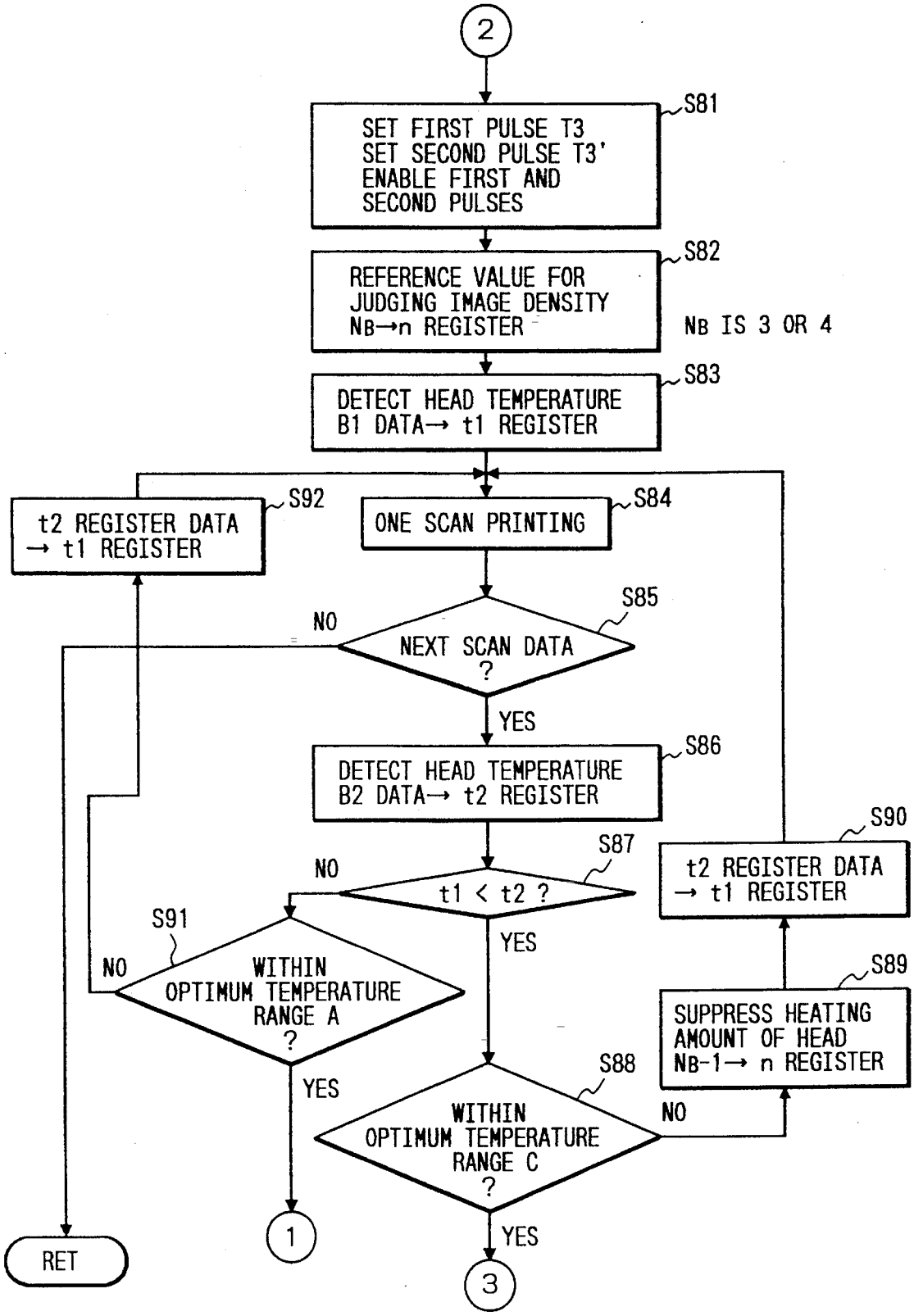

Next, the operation in the cases where the head temperature is judged in S65 of FIG. 14 to be in the optimum temperature range B, where the head temperature rises from the optimum temperature range A to the optimum temperature range B, and where the head temperature falls from the optimum temperature range C to the optimum temperature range B will be described with reference to FIG. 16. In the case where the current head temperature is in the optimum temperature range B, in S81, the print drive pulse width data of T3 which is optimum for this temperature range is set in the first storage device 38, and the print drive pulse width data of T3' for generating a pulse shorter than T3 seconds is set in the second storage device 39. In the case where the head temperature is in the optimum temperature B, in S82, the judgment of the print density in the image density detecting unit 40 is enabled, and a reference value $N_B$ for the judgment is set in an N register of the image density detecting unit 40. An initial value of the reference value $N_B$ is 3 or 4 so that the control for suppressing the temperature is gently performed. The print data generating operation in the print data processing unit 41 is inhibited. In S83, in order to detect the changing tendency of the head temperature before and after the print operation, a head temperature B1 (° C.) before the printing is detected and stored in, for example, a t1 register of the work RAM 4.

In S84, the printing for one scanning is performed. The print operation is the same as that in the optimum temperature range B which is described above. In S85, it is judged whether or not there is data to be printed next. If there is no data, the print operation and the temperature control operation are terminated. If there is data to be printed next, the head temperature B2 (° C.) after the printing for one scanning is detected in S86 and stored in, for example, a t2 register of the work RAM 4. Then, in S87, the head temperature stored in the t1 register is compared with the head temperature stored in the t2 register, to judge the changing tendency of the head temperature due to the printing for one scanning. If the head temperature stored in the t2 register is higher, i.e., the head temperature has the rising tendency in S87, it is judged in S88 whether or not the head temperature reaches the optimum temperature range C. If the head temperature rises to the optimum temperature range C, the temperature control is shifted to that for the optimum temperature range C. If the head temperature has the rising tendency but remains in the optimum temperature range B in S88, the reference value $N_B$ used for the judgment in the image density detecting unit 40 is decremented in S89 by 1 and set in the N register of the image density detecting unit 40, in order to prevent the temperature from rising further more. As a result, the suppression of the heating amount of the head is further increased. In S90, the temperature data in the t2 register which indicates the current head temperature is transferred to the t1 register to be used as the temperature data before the printing. Then, the process returns to S84, and the printing for one scanning is repeated. If the head temperature is unchanged or has the falling tendency in S87, it is judged in S91 whether or not the head temperature falls to the optimum temperature range A. If the head temperature falls to the optimum temperature range A, the temperature control is shifted to that for the optimum temperature range A. If the head temperature remains in the optimum temperature range B, the temperature control is continued. In S92, the current head temperature data is transferred to the t1 register to be used as the temperature data before the printing. Then, the process returns to S84, and the printing for one scanning is repeated.

Figure 17:
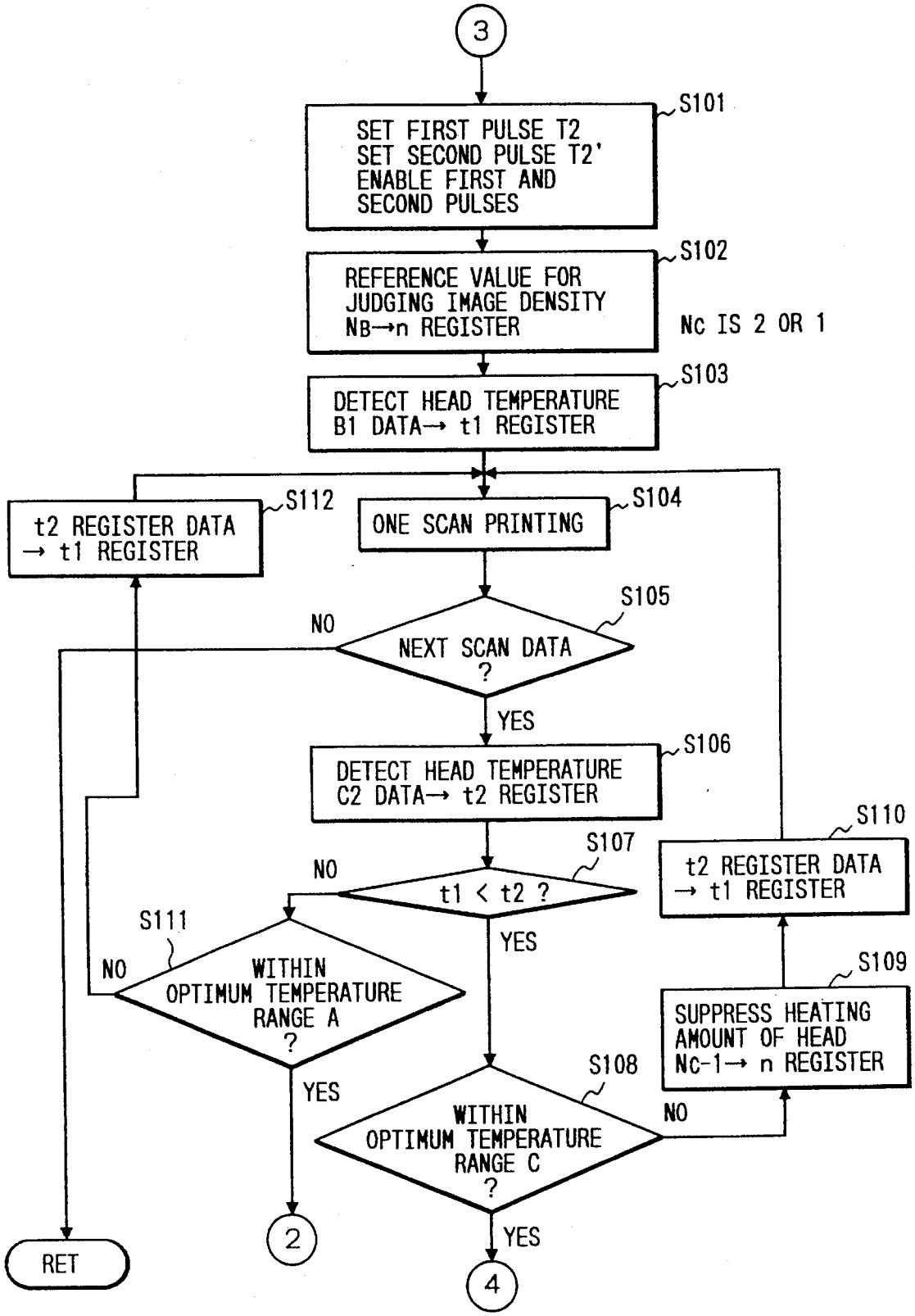

The operation in the cases where the head temperature is judged in S66 of FIG. 14 to be in the optimum temperature range C, where the head temperature rises from the optimum temperature range B to the optimum temperature range C, and where the head temperature falls from the higher temperature range to the optimum temperature range C will be described with reference to FIG. 17. In the case where the current head temperature is in the optimum temperature range C, in S101, the print drive pulse width data of T2 which is optimum for this temperature range is set in the first storage device 38, and the drive pulse width data of T2' for generating a pulse shorter than T2 is set in the second storage device 39. In the case where the head temperature is in the optimum temperature range C, in S102, the judgment of the print density in the image density detecting unit 40 is enabled, and a reference value $N_C$ for the judgment is set in the N register of the image density detecting unit 40. An initial value of the reference value $N_C$ is 2 or 1 so that the temperature suppressing control is performed for suppressing the heat generation as much as possible. The print data generation operation in the print data processing unit 41 is inhibited. In S103, in order to detect the changing tendency of the head temperature before and after the print operation, a head temperature C1 (° C.) before the recording is detected and stored in, for example, the t1 register of the work RAM 4.

In S104, the printing for one scanning is performed. The print operation is the same as that in the optimum temperature range B which is described above. In S105, it is judged whether or not there is data to be printed next. If there is no data, the print operation and the temperature control operation are terminated. If there is data to be printed next, in S106, a head temperature C2 (° C.) after the printing for one scanning is detected and stored in, for example, the t2 register of the work RAM 4. In S107, the head temperature stored in the t1 register is compared with the head temperature stored in the t2 register, to judge the changing tendency of the head temperature due to the printing for one scanning. If, in S107, the head temperature stored in the t2 register is higher, i.e., the head temperature has the rising tendency, it is judged in S108 whether or not the head temperature reaches the higher temperature range. If the head temperature rises to the higher temperature range, the temperature control is shifted to that for the higher temperature range. If, in S108, the head temperature has the rising tendency but remains in the optimum temperature range C, the reference value $N_C$ for the judgment in the image density detecting unit 40 is decremented by 1 in S109 and set in the N register of the image density detecting unit 40, in order to reduce the heating amount and prevent the temperature from rising. As a result, the suppression of the heating amount of the head is further increased. In S110, the temperature data in the t2 register which indicates the current head temperature is transferred to the t1 register to be used as a the temperature data before the printing. Then, the process returns to S104, and the printing for one scanning is performed again. If, in S107, the head temperature is unchanged or has the falling tendency, it is judged in S111 whether or not the head temperature falls to the optimum temperature range B. If the head temperature falls to the optimum temperature range B, the temperature control is shifted to that for the optimum temperature range B. If the head temperature remains in the optimum temperature range C, the temperature control is continued. In S112, the current head temperature data is transferred to the t1 register to be used as the head temperature data before the printing. The process returns to S104 and the printing for one scanning is repeated.

Figure 18:
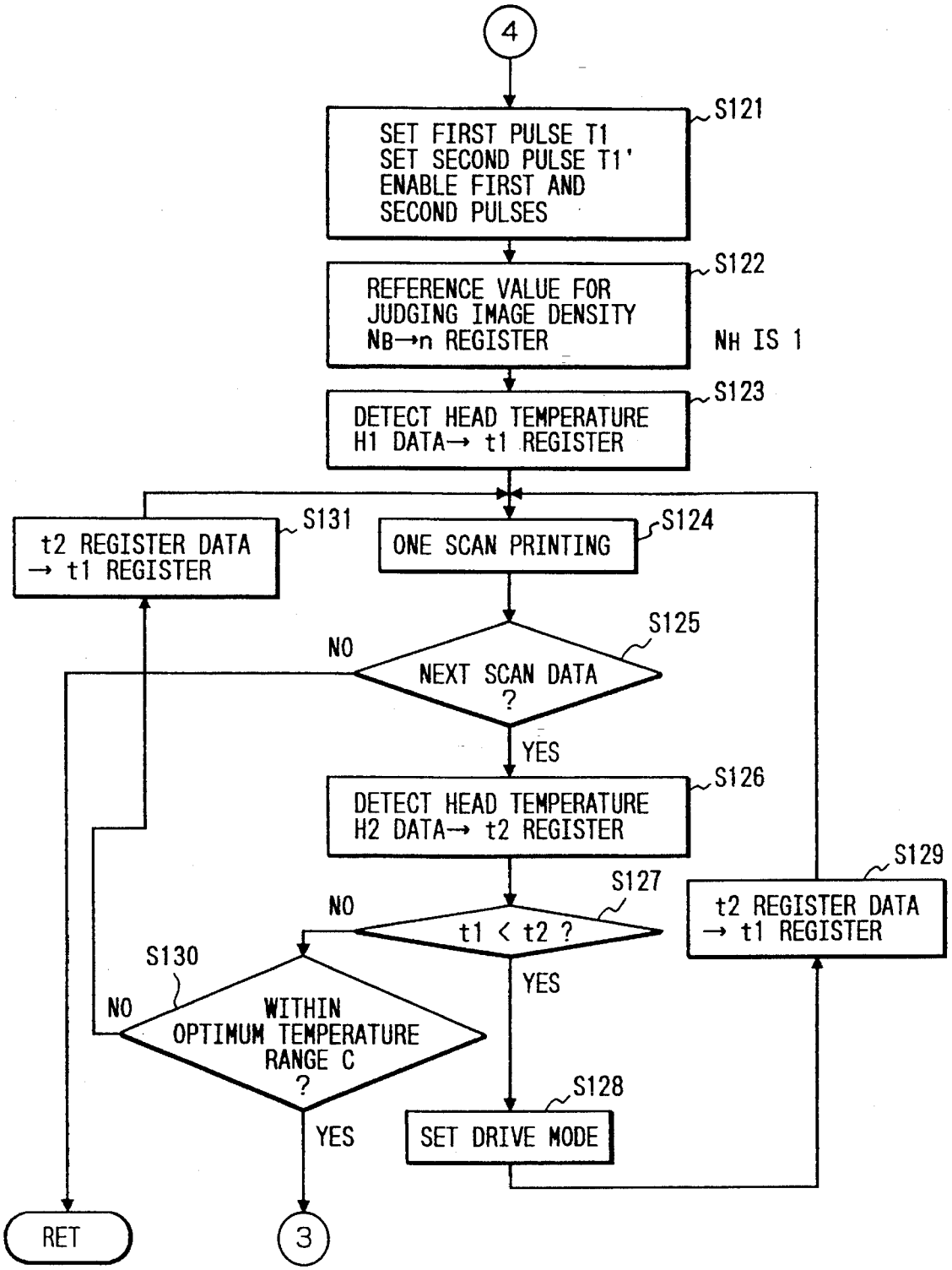

The operation in the cases where the head temperature is judged in S66 of FIG. 14 to be in the higher temperature range, and where the head temperature rises from the optimum temperature range C to the higher temperature range will be described with reference to FIG. 18. In the case where the current head temperature is in the higher temperature range, in S121, the print drive pulse width data of T1 which is optimum for this temperature range is set in the first storage device 38, and the drive pulse width data of T1' for generating a pulse shorter than T1 is set in the second storage device 39. In addition, in S122, a reference value $N_H$ for the judgment is set in the N register of the image density detecting unit 40. An initial value of the reference value $N_H$ is 1 which is the minimum value, and the temperature suppressing control for suppressing the heating at the maximum is performed. The print data generating operation in the print data processing unit 41 is inhibited. In S123, in order to detect the changing tendency of the head temperature before and after the print operation, a head temperature H1 (° C.) before the printing is detected and stored in, for example, the t1 register of the work RAM 4.

In S124, the printing for one scanning is performed. The first print operation is the same as that in the optimum temperature range B. In S125, it is judged whether or not there is data to be printed next. If there is no data, the recording operation and the temperature control operation are terminated. If there is data to be printed next, the head temperature H2 (° C.) after the printing for one scanning is detected in S126 and stored in, for example, the t2 register of the work RAM 4. In S127, the head temperature stored in the t1 register is compared with the head temperature stored in the t2 register, to judge the changing tendency of the head temperature due to the printing for one scanning. If, in S127, the head temperature stored in the t2 register is higher, i.e., the head temperature has the rising tendency, it is judged that the head temperature rising cannot be stopped only by switching the print drive pulse width data. Then, in S128, a drive mode in which the head temperature rise is small, e.g., a drive mode in which the data to be printed in one scanning is controlled so as to be printed in two scanning is set. During the succeeding print operations or the print operations performed until the head temperature is no longer in the higher temperature range, this drive mode is employed. In S129, the temperature data in the t2 register which indicates the current temperature is transferred to the t1 register to be used as the temperature data before the printing. The process returns to S124, and the printing for one scanning is performed in the set drive mode. If, in S127, the head temperature is unchanged or has the falling tendency, it is judged in S130 whether or not the head temperature falls to the optimum temperature range C. If the head temperature falls to the optimum temperature range C, the temperature operation is shifted to that for the optimum temperature range C. If the head temperature remains in the higher temperature range, the temperature control for lowering the head temperature is continued. In S131, the current head temperature data is transferred to the t1 register to be used as the head temperature data before the printing. The process returns to S124, and the recording for one scanning is repeated.

Figure 19:
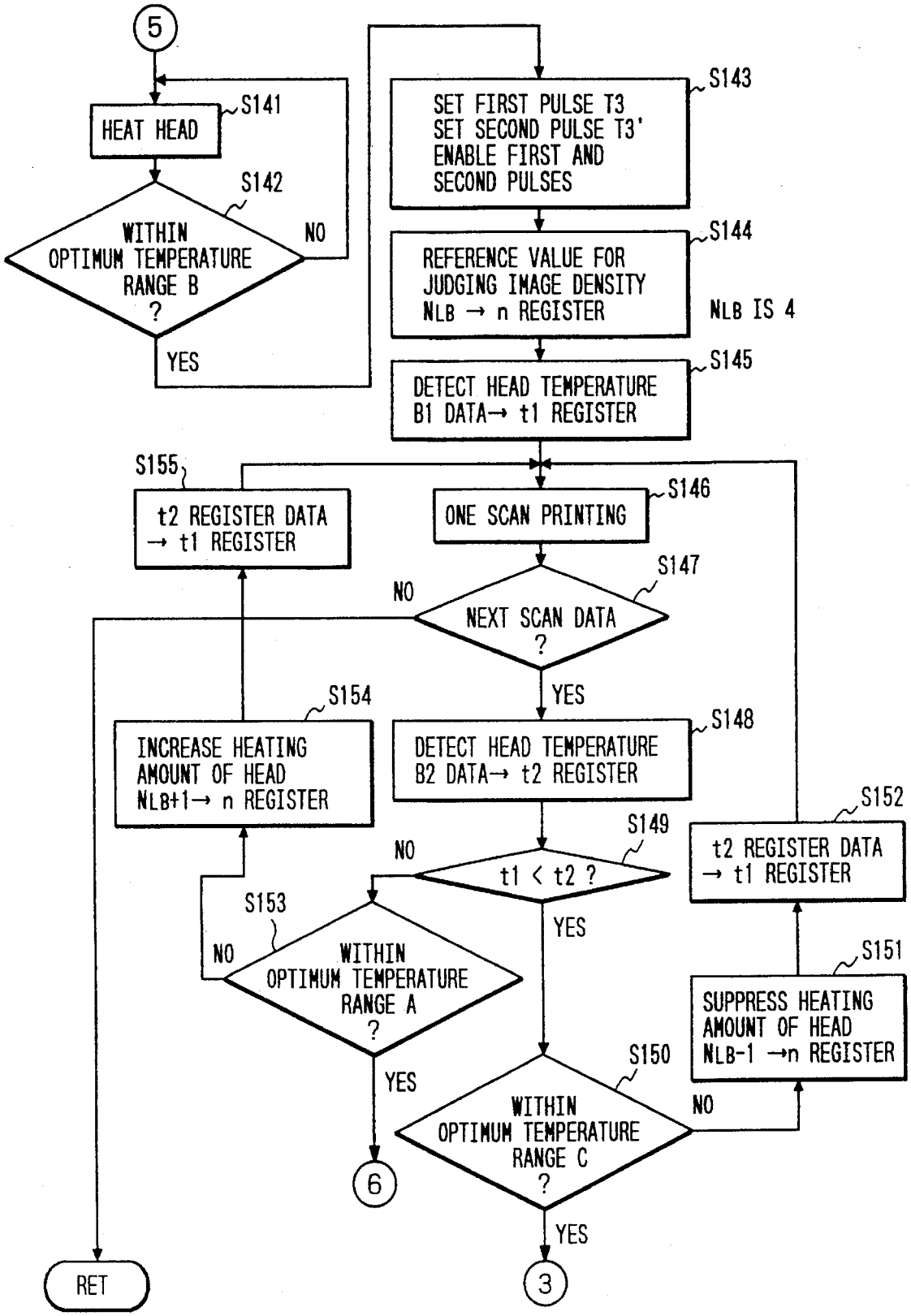
Figure 20:
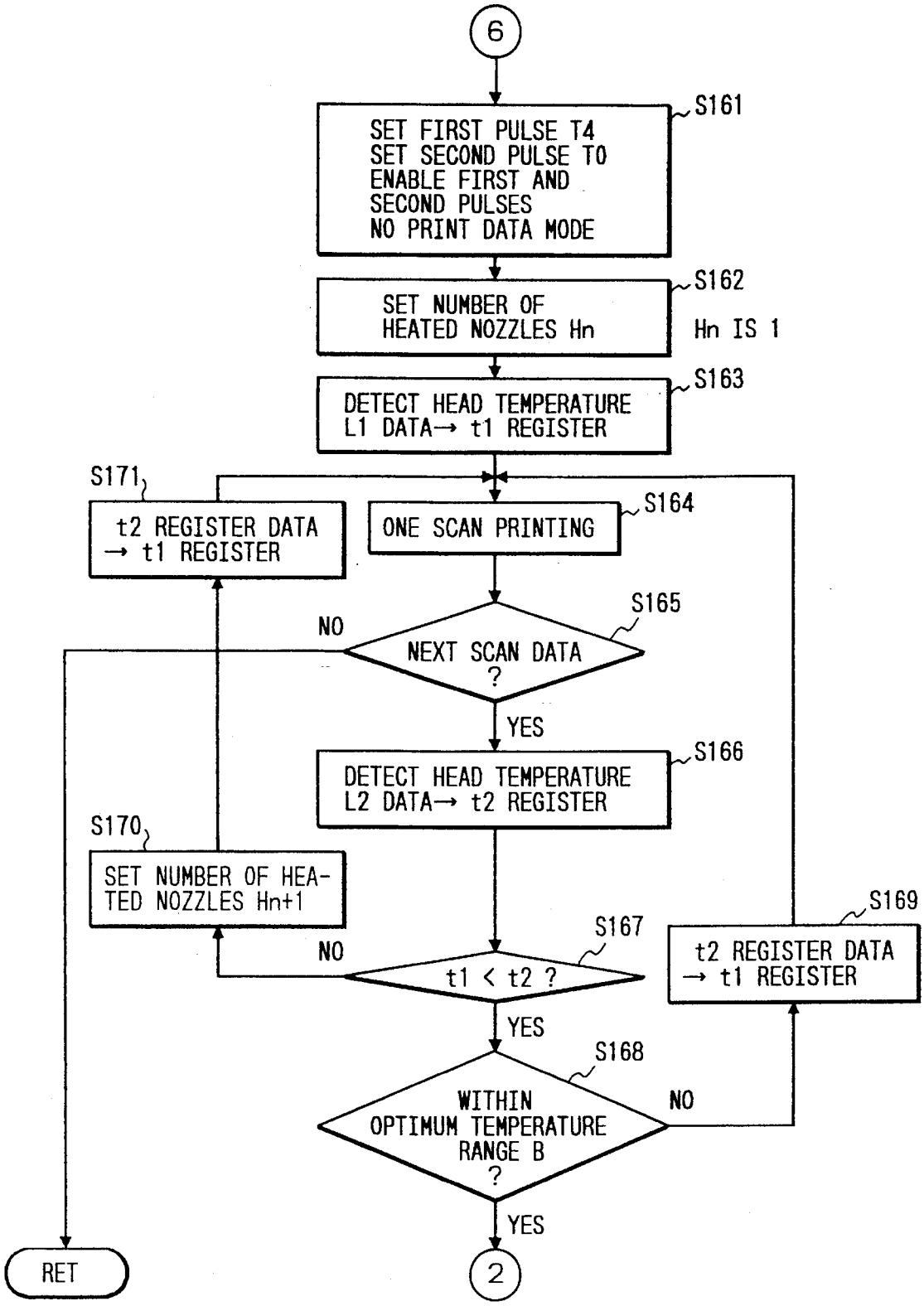

The operation in the case where the head temperature is judged in S63 of FIG. 14 to be in the lower temperature range will be described with reference to FIGS. 19 and 20. If the current head temperature is in the lower temperature range, the head is heated in S141 and S142 to the optimum temperature range B before the start of the print operation. As a method of heating, the head is caused to eject ink, or the head is driven by a drive pulse by which ink is not ejected.

After the head is heated to the optimum temperature range B, if the head temperature exceeds the optimum temperature range B, the temperature control operation is performed in the same manner as that in the optimum temperature range B which is described above. Specifically, in S143, the print drive pulse width data of T3 which is optimum for this temperature range, i.e., the optimum temperature range B is set in the first storage device 38, and the drive pulse width data of T3' for generating a pulse shorter than T3 is set in the second storage device 39. In S144, the judgment of the print density in the image density detecting unit 40 is enabled, and a reference value $N_{LB}$ for the judgment is set in the N register of the image density detecting unit 40. In the case where the environmental temperature is in the lower temperature range, the control is performed so that the heat generation is conducted in the head as much as possible. Accordingly, an initial value of the reference value $N_{LB}$ is 4 which is the maximum value. At this time, the print data generating operation in the print data processing unit 41 is inhibited. In S145, a head temperature B1 (° C.) before the printing is detected and stored in, for example, the t1 register of the work RAM 4.

In S146, the printing for one scanning is performed. The print operation is the same as that in the optimum temperature range B which is described above. In S147, it is judged whether or not there is data to be printed next. If there is no data, the print operation and the temperature control operation are terminated. If there is data to be printed next, the head temperature B2 (° C.) after the printing for one scanning is detected in S148 and stored in, for example, the t2 register of the work RAM 4. In S149, the head temperature stored in the t1 register is compared with the head temperature stored in the t2 register, so that the changing tendency of the head temperature due to the printing for one scanning is judged. If, in S149, the head temperature stored in the t2 register is higher, i.e., the head temperature has the rising tendency, it is judged in S150 whether or not the head temperature reaches the optimum temperature range C. If the head temperature rises to the optimum temperature range C, the temperature control is shifted to that for the optimum temperature range C. If, in S150, the head temperature has the rising tendency but remains in the optimum temperature range B, the reference value $N_{LB}$ for the judgment in the image density detecting unit 40 is decremented by 1 in S151 and set in the N register of the image density detecting unit 40, in order to reduce the heating amount and prevent the temperature from rising. As a result, the heating amount generated in the head is suppressed, and the head temperature is prevented from rising further. In S152, the temperature data in the t2 register which indicates the current head temperature is transferred to the t1 register to be used as the temperature data before the printing. The process returns to S146, and the printing for one scanning is repeated. If, in S149, the head temperature is unchanged or has the falling tendency, it is judged in S153 whether or not the head temperature falls to the optimum temperature range A. If the head temperature remains in the optimum temperature range B, the reference value $N_{LB}$ for the judgment in the image density detecting unit 40 is incremented by 1 in S154 and set in the N register of the image density detecting unit 40, in order to prevent the head temperature from falling. Accordingly, the heating amount of the head is increased, so that the head temperature is prevented from falling further. In S155, the current head temperature data is transferred to the t1 register to be used as the head temperature data before the printing. The process returns to S146, and the printing for one scanning is repeated. If it is judged in S153 that the head temperature falls to the optimum temperature range A, the temperature control is shifted to that for the optimum temperature range A under the low temperature environment, so that the heating is performed also in the optimum temperature range A, as shown in FIG. 20. The reason is that, if the nodal temperature control for the optimum temperature range A is continued, there is a possibility that the head temperature falls further and returns to the lower temperature range.

If the head temperature falls from the optimum temperature range B to the optimum temperature range A under a low temperature environment, in S161, the print drive pulse width data of T4 which is optimum for this temperature range is set in the first storage device 38, and the drive pulse width data of T0 by which ink is not ejected from a nozzle is set in the second storage device 39. In addition, in this mode, the image density detecting unit 40 is set so as to perform the judgment of the existence of print data. In S162, the number of nozzles Hn of one nozzle, group which are to be heated when the operation of the print data processing unit 41 is enabled and it is judged that there is no print data in the image density detecting unit 40 is set in the print data processing unit 41. In S163, in order to detect the changing tendency of the head temperature before and after the printing, a head temperature L1 (° C.) before the printing is detected and stored in, for example, the t1 register of the work RAM 4.

In S164, the printing for one scanning is performed. The printing operation is the same as that in the case where the head temperature falls to the optimum temperature range A under the low temperature environment which is described above. In S165, it is judged whether or not there is data to be printed next. If there is no data, the print operation and the temperature control operation are terminated. If there is data to be printed next, the head temperature L2 (° C.) after the printing for one scanning is detected in S166 and stored in, for example, the t2 register of the work RAM 4. In S167, the head temperature stored in the t1 register is compared with the head temperature stored in the t2 register, so that the changing tendency of the head temperature due to the recording for one scanning is judged. If, in S167, the head temperature stored in the t2 register is higher, i.e., the head temperature has the rising tendency, the rising of the head temperature is maintained. In S168, it is judged whether or not the head temperature reaches the optimum temperature range B. If the head temperature rises to the optimum temperature range B, the temperature control is shifted to that for the optimum temperature range B. If, in S168, the head temperature has the rising tendency but remains in the optimum temperature range A, the temperature data in the t2 register which indicates the current head temperature is transferred in S169 to the t1 register to be used as the temperature data before the printing. The temperature control is continued and the process returns to S164 to repeat the printing for one scanning. If, in S167, the head temperature is unchanged or has the falling tendency, it is required to heat the head further. Accordingly, the number of nozzles Hn to be heated in one nozzle group which is set in the print data processing unit 41 is incremented by 1 in S170, so that the heating amount of the head with no print data is increased. In S171, the current head temperature is transferred to the t1 register to be used as the head temperature data before the printing. The process returns to S164, and the printing for one scanning is repeated.

In the above, the temperature control operations according to the present invention depending on the environmental temperature and the head temperature have been described. In general, it is most preferable that the drive pulses used in the above description satisfy a condition of:

$$T4>T4'\geqq T3>T3'\geqq T2>T2'\geqq T1>T1'>T0$$

Alternatively, in order to reduce the number of drive pulse width data pieces, the following drive pulse width data may be used:

$$T432\ T3=T2=T1=Tm;$$

$$T4'=T3'=T2'=T1'=Ts;$$

and $$Tm>Ts>T0.$$

Also in this case, the control for keeping the temperature constant can be sufficiently achieved under any temperature environment by performing the aggressive control of the reference value N for the print density of the image density detecting unit 40 and the arbitrary data generating control of the data processing unit 41. The control was realized when employing the following values as representative values for Tm, Ts and T0:

$$Tm=3.00\ \text{sec},$$

$$Ts=2.75\ \text{sec},$$

and $$T0=1.00\ \text{sec}.$$

It is appreciated that the application of the present invention is not limited to a printer system, and the present invention is applicable to a recording device such as a facsimile, or a copying machine which uses an ink-jet head.

As apparent from the above description, according to the present invention, the ink-jet recording apparatus has the first storage device and the second storage device. The drive pulse width data stored in the first storage device and the second storage device are switched over at a high speed, depending on the environmental temperature in which the ink-jet recording apparatus is located, and the image density to be printed. Therefore, the head temperature control can be stably performed under any temperature environment. Moreover, the drive pulse width data by which ink is not ejected is set in the second storage device, or pseudo print data are generated. Therefore, it is possible to,remarkably improve the temperature control precision under a low temperature environment.

By the above controls, the ink ejection characteristics can be made stable, and the high quality image can be maintained under any temperature environment. Furthermore, even under a low temperature environment, the recording can be performed while the head temperature is controlled to be in a certain prescribed range. Therefore, the density variation in one sheet or between pages can be eliminated. In addition, even under a high temperature environment, the head temperature is controlled so as to be in a certain prescribed range, so that it is possible to increase the number of sheets which can be continuously printed.

What is claimed is:

1. An ink-jet recording apparatus comprising:

a carriage adapted to move relative to a recording medium;

a plurality of heads detachably mounted on said carriage;

a plurality of nozzles arranged on each of said heads, and said nozzles being divided into a plurality of nozzle groups so that each of said nozzle groups has a predetermined number of said nozzles and each of said nozzle groups sequentially ejects ink to perform recording for one line in an arrangement direction of said nozzles;

first storage means for storing a piece of drive pulse width data for driving said nozzles;

second storage means for storing one or more pieces of drive pulse width data for driving said nozzles;

a plurality of drive pulse generating devices for generating a drive pulse width for driving said nozzle groups in accordance with said drive pulse width data stored in said first storage means and said second storage means, said plurality of drive pulse generating devices corresponding in number to said plurality of heads;

temperature detecting means for detecting temperature of at least one of said plurality of heads;

means for setting said drive pulse width data stored in said first memory means to be variable in a range where ink can be ejected, and for setting said drive pulse width data stored in said second memory means to be variable in a range where ink can be ejected within a preset temperature range and to be variable in a range where ink cannot be ejected at a preset temperature or lower than said preset temperature, said drive pulse width data stored in said firs memory means being greater than said drive pulse width data stored in said second memory means; and a print density detecting device for detecting a print density in said nozzle groups to be driven during a print recording operation at said preset temperature or higher than said preset temperature, and means for selecting either of said drive pulse width data stored in said first memory means and said drive pulse width data stored in said second memory means in accordance with an output from said print density detecting device so as to sequentially generate a drive pulse and to sequentially drive said plurality of nozzle groups.

2. The ink-jet recording apparatus of claim 1, including means for variably setting a reference value to select either of said drive pulse width data stored in said first memory means and said drive pulse width data stored in said second memory means.

3. The ink-jet recording apparatus of claim 1, wherein the number of said plurality of nozzles to be simultaneously driven is at least one nozzle.

4. An ink-jet recording apparatus comprising:

a carriage adapted to move relative to a recording medium;

a plurality of heads detachably mounted on said carriage;

a plurality of nozzles arranged on each of said heads, and said nozzles being divided into a plurality of nozzle groups so that each of said nozzle groups has a predetermined number of said nozzles and each of said nozzle groups sequentially ejects ink to perform recording for one line in an arrangement direction of said nozzles;

first storage means for storing a piece of drive pulse width data for driving said nozzles;

second storage means for storing one or more pieces of drive pulse width data for driving said nozzles;

a plurality of drive pulse generating devices for generating a drive pulse width for driving said nozzle groups in accordance with said drive pulse width data stored in said first storage means and said second storage means, said plurality of drive pulse generating devices corresponding in number to said plurality of heads;

temperature detecting means for detecting temperature of at least one of said plurality of heads;

means for setting said rive pulse width data stored in said first memory means to be variable in a range where ink can be ejected, and for setting said drive pulse width data stored in said second memory means to be variable in a range where ink can be ejected within a preset temperature range and to be variable in a range where ink cannot be ejected at a preset temperature or lower than said preset temperature, said drive pulse width data stored in said first memory means being greater than said drive pulse width data stored in said second memory means;

a processing control device for controlling data to be printed, wherein said processing control device generates said data so as to allow said head to operate in case that there is not said data to be printed in said nozzle groups to be driven under non ink ejecting condition during a print recording operation at said preset temperature or lower than said preset temperature, and wherein only said drive pulse width data stored in said first memory means is used; and means for inhibiting use of said drive pulse width data stored in said second memory means, and for inhibiting generation of said data to be printed in said processing control device during said print recording operation within said preset temperature range.

5. The ink-jet recording apparatus of claim 4, including means for controlling said processing control device to operate at said preset temperature or lower than said preset temperature, to generate data for causing at least one nozzle in said nozzle groups to be driven to print, and to selectively determine the number of data pieces to be generated and the position of said nozzle.

* * * * *

UNITED STATES PATENT AND TRADEMARK OFFICE

CERTIFICATE OF CORRECTION

PATENT NO. : 5,477,245

DATED : December 19, 1995

INVENTOR(S) : Takeshi FUSE

It is certified that error appears in the above-indentified patent and that said Letters Patent is hereby corrected as shown below:

On the title page: Item [54] and Column 1, line 1, "TEMPERATURES" should read -- TEMPERATURES--.

Claim 1, column 25, line 64, "firs" should read --first--.

Claim 4, column 26, line 45, "rive" should read --drive--.

Abstract, line 1, delete "of the present invention".

Signed and Sealed this

Twenty-eighth Day of May, 1996

*Attest:*

Bruce Lehman

BRUCE LEHMAN

*Attesting Officer*

*Commissioner of Patents and Trademarks*